US009598887B2

(12) United States Patent
Reed et al.

(10) Patent No.: US 9,598,887 B2
(45) Date of Patent: Mar. 21, 2017

(54) HIDDEN HINGE DOOR SYSTEM AND METHOD FOR USE IN RESIDENTIAL AND COMMERCIAL BUILDINGS

(71) Applicant: Margaret B. Reed, Broomfield, CO (US)

(72) Inventors: Margaret B. Reed, Broomfield, CO (US); Robert Butcher, Longmont, CO (US)

( * ) Notice: Subject to any disclaimer, the term of this patent is extended or adjusted under 35 U.S.C. 154(b) by 0 days.

(21) Appl. No.: 14/998,772

(22) Filed: Feb. 12, 2016

(65) Prior Publication Data

US 2016/0245004 A1 Aug. 25, 2016

Related U.S. Application Data

(60) Provisional application No. 62/176,423, filed on Feb. 18, 2015.

(51) Int. Cl.
*A47G 29/087* (2006.01)
*E05D 7/00* (2006.01)
*E05D 3/06* (2006.01)

(52) U.S. Cl.
CPC ..... *E05D 7/0009* (2013.01); *E05D 3/06* (2013.01)

(58) Field of Classification Search
CPC ..... E05D 15/58; E06B 3/5045
USPC ..... 312/322
See application file for complete search history.

(56) References Cited

U.S. PATENT DOCUMENTS 2,721,353 A 10/1955 Mackintosh
2,956,303 A 10/1956 Fielder
3,004,303 A 10/1961 Wilmer
3,626,548 A 12/1971 Grunert
3,673,635 A 7/1972 Cencioni
3,863,292 A 2/1975 Grunert et al.
3,978,549 A 9/1976 Vitt
4,118,827 A * 10/1978 Yamamoto ..... E05D 5/04 16/252
4,236,272 A 12/1980 Gronbach et al.
(Continued)

OTHER PUBLICATIONS

Appliance Design Magazine, Nov. 2004, p. 18.
Download of concealed hinge from http://www.hardwaresource.com.

*Primary Examiner* — Leslie A Nicholson, III
*Assistant Examiner* — Kimberley S Wright

(57) ABSTRACT

A system and method that uses hidden hinges and mounts an article of furniture (such as a bookcase) or a door into a doorframe surrounding an opening in a wall or a building. The system and method comprise a vertical frame structure having a plurality of vertical segments that can be attached and detached to adjust the height of the vertical frame. The vertical frame is attached to the doorframe using two hinge modules, one near the top of the doorframe and other near the bottom of the doorframe. Each hinge module comprises linkages that rotate the vertical frame and facilitate the rotation of the hidden hinge mechanisms, attached vertical frame, and furniture article (or door) about a pivot point in an arc that spans at least 90 degrees from a closed position to an open position. The system and method further comprise features that facilitate adjustment of the furniture article (or door) relative to the doorframe in three mutually perpendicular axes and three mutually perpendicular rotations about the three mutually perpendicular axes.

20 Claims, 18 Drawing Sheets

(56) References Cited

U.S. PATENT DOCUMENTS 4,302,907 A * 12/1981 Canals ..... E05C 7/02 292/150
4,383,347 A 5/1983 La Conte
4,389,748 A * 6/1983 Grossman ..... E05D 3/12 16/278
4,499,631 A 2/1985 Lautenschlager
4,736,491 A 4/1988 Mertes
4,825,610 A * 5/1989 Gasteiger ..... E06B 1/6092 52/217
5,103,532 A 4/1992 Youngdale et al.
5,497,534 A 3/1996 Caruso
6,196,618 B1 3/2001 Pietryga et al.
6,526,694 B1 * 3/2003 Cosgrove ..... E05B 65/06 49/163
6,530,186 B2 * 3/2003 Torstensen ..... E04F 21/0015 248/354.1
6,701,575 B2 * 3/2004 Padiak ..... E05D 5/023 16/221
6,842,944 B2 * 1/2005 Maurer ..... E05D 3/14 16/366
7,357,354 B2 4/2008 Mortland
7,591,046 B2 9/2009 Zetti
7,650,670 B2 * 1/2010 Baer ..... E05D 3/122 16/236
7,698,785 B2 4/2010 Bennett
7,987,558 B2 8/2011 Beckmann et al.
8,296,906 B2 10/2012 Wisniewski
8,434,197 B2 * 5/2013 Oshima ..... E05D 3/186 16/241
8,793,935 B2 * 8/2014 Makarewicz ..... E05D 5/023 16/382
8,850,661 B2 * 10/2014 Liermann ..... E05D 3/186 16/357
9,057,216 B2 * 6/2015 Bortoluzzi ..... E05D 15/58
9,254,918 B2 * 2/2016 Young ..... B64D 11/02
2001/0020811 A1 * 9/2001 Kawanabe ..... E05D 15/408 312/319.2
2003/0024072 A1 * 2/2003 Nussbaum ..... E05D 5/0238 16/235
2003/0101652 A1 * 6/2003 Cosgrove ..... E05B 65/06 49/63
2007/0261201 A1 * 11/2007 Baer ..... E05D 3/122 16/236
2010/0242366 A1 * 9/2010 Liebscher ..... E05D 15/58 49/142
2012/0117757 A1 * 5/2012 Oshima ..... E05D 3/186 16/236
2012/0180396 A1 * 7/2012 Liermann ..... E05D 3/186 49/398
2013/0000203 A1 * 1/2013 Platt ..... E05D 3/08 49/246
2014/0158826 A1 * 6/2014 Young ..... B64D 11/02 244/118.5
2016/0037662 A1 * 2/2016 Terao ..... F16M 11/00 248/283.1
2016/0047160 A1 * 2/2016 Huynh ..... E05F 15/77 49/31
2016/0195325 A1 * 7/2016 Kim ..... F25D 23/028 312/405

* cited by examiner

FIG. 9A
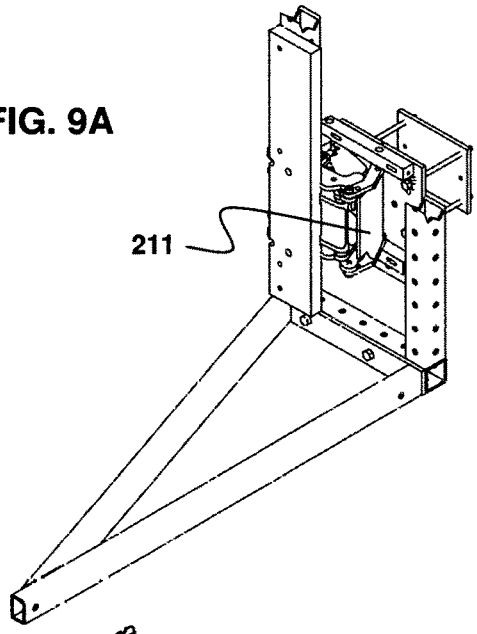
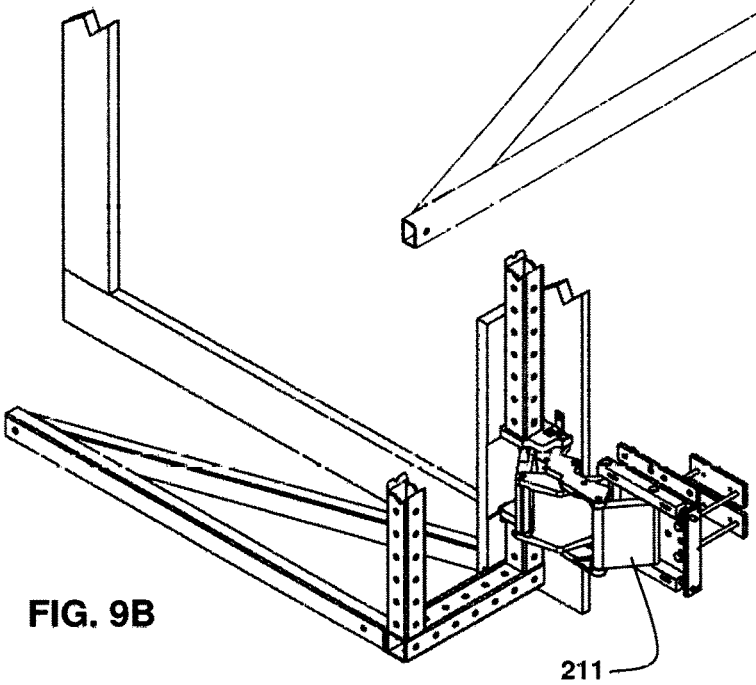
FIG. 9B
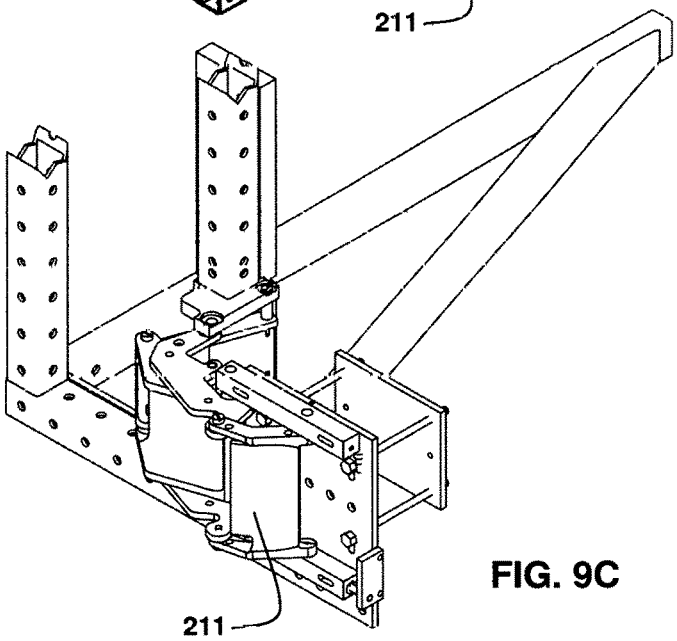
FIG. 9C

HIDDEN HINGE DOOR SYSTEM AND METHOD FOR USE IN RESIDENTIAL AND COMMERCIAL BUILDINGS

CROSS-REFERENCE TO RELATED APPLICATIONS

This application claims benefit of U.S. Provisional Patent Application Ser. No. 62/176,423 filed Feb. 18, 2015, which is hereby incorporated by reference in its entirety.

BACKGROUND OF THE DISCLOSURE

This disclosure relates to systems and methods for fabricating and installing a hidden hinge door for use in residential and commercial buildings. Hidden hinge doors of the type disclosed here, typically look like an article of furniture attached, built-in, or placed adjacent to a wall, that can be moved to reveal an opening in the wall. One example might be a bookcase that appears to be built into a wall that can be rotated like a door to provide a passageway through the wall. The system and method described in this disclosure can also be used for a very heavy door (in a residential or commercial building) that looks like a door, but needs a hidden hinge and support system with the functionality described herein.

Some of the challenges in making a reliable high-quality hidden hinge door include:

a) Must support heavy weight. For example, if the door is an actual bookcase filled with actual books, or paper files, the weight of this paper would be considerably greater than the weight of a normal door. A hardbound 200-page book that is 6 inches by 9 inches weighs about 0.7 pounds. If there were 300 books of this size in the bookcase, the total weight of the books would be over 200 pounds. A 3-foot drawer for holding 8.5×11 inch files can hold about 18 reams of paper, each of which weighs about 6 pounds, which means a total of over 100 pounds per file drawer.

b) Accurate alignment and fit. There should not be any obvious visible gaps or skews. Thus, the bookcase should be placed and oriented correctly in six degrees of freedom: three mutually perpendicular linear axes and three mutually perpendicular rotations. The three mutually perpendicular linear axes would typically be a horizontal (right-left) or x-axis, a vertical (up-down) or y-axis, and an axis perpendicular to the wall (going in and out) or z-axis. The three mutually perpendicular rotations would typically be rotation about the x-axis, rotation about the y-axis, and rotation about the z-axis. Rotation about the x-axis can also be called pitch and represents a movement in and out of the top of the bookcase relative to the bottom of the bookcase. Rotation about the y-axis can also be called yaw and represents a movement in and out of the left side of the bookcase relative to the right side of the bookcase. Rotation about the z-axis can also be called roll and represents a clockwise or counterclockwise rotation of the bookcase when looked at from the front. A good system would include adjustment possibilities in all six of these degrees of freedom to ensure that the bookcase can be correctly aligned when installed.

c) Rigidity. The structure and its mounting must maintain alignment in the three axes and three rotations at all positions with its heavy load.

d) No visible hinges. There should not be any exposed hinges like there are for a normal door. If the hinges were visible, this would not be a "hidden hinge door".

e) Large rotation. A bookcase is thick (or deep) and width of the opening in which it sits is limited, which means that the bookcase should rotate as close to a full 180 degrees as possible. If the bookcase cannot rotate far enough, the width when the "door" is open is reduced. For example, if the wall opening is 30 inches wide and the bookcase is 10 inches deep, one third of the opening is blocked if the case only rotates 90 degrees.

f) Adaptability. The frame system for the bookcase should fit a range of wall openings. Conventional doors and door openings in a wall come in different widths and heights. To minimize the number of stock-keeping units (SKUs), the frame hardware should accommodate a broad of wall opening widths and height. The frame hardware should be the same for doors that swing from the right or the left.

g) Compact shipping. The cost of shipping a pre-assembled hidden hinge door system (including bookcase, storage cabinet or similar) is much more than shipping only structural components in a smaller box to be assembled on-site using a locally fabricated article of furniture (bookcase, storage cabinet, etc).

h). Ease of installation.

This disclosure describes novel embodiments designed to best fulfill the above needs.

BRIEF DESCRIPTION OF THE DRAWINGS

The present disclosure is described in conjunction with the appended documents in which:

FIG. 9A shows an isometric view of a bottom hinge module in the 0 degree (closed) position;

FIG. 9B shows an isometric view of a bottom hinge module in the 90 degree (half open) position;

FIG. 9C shows an isometric view of a bottom hinge module in the 180 degree (fully open) position;

Figure 1:
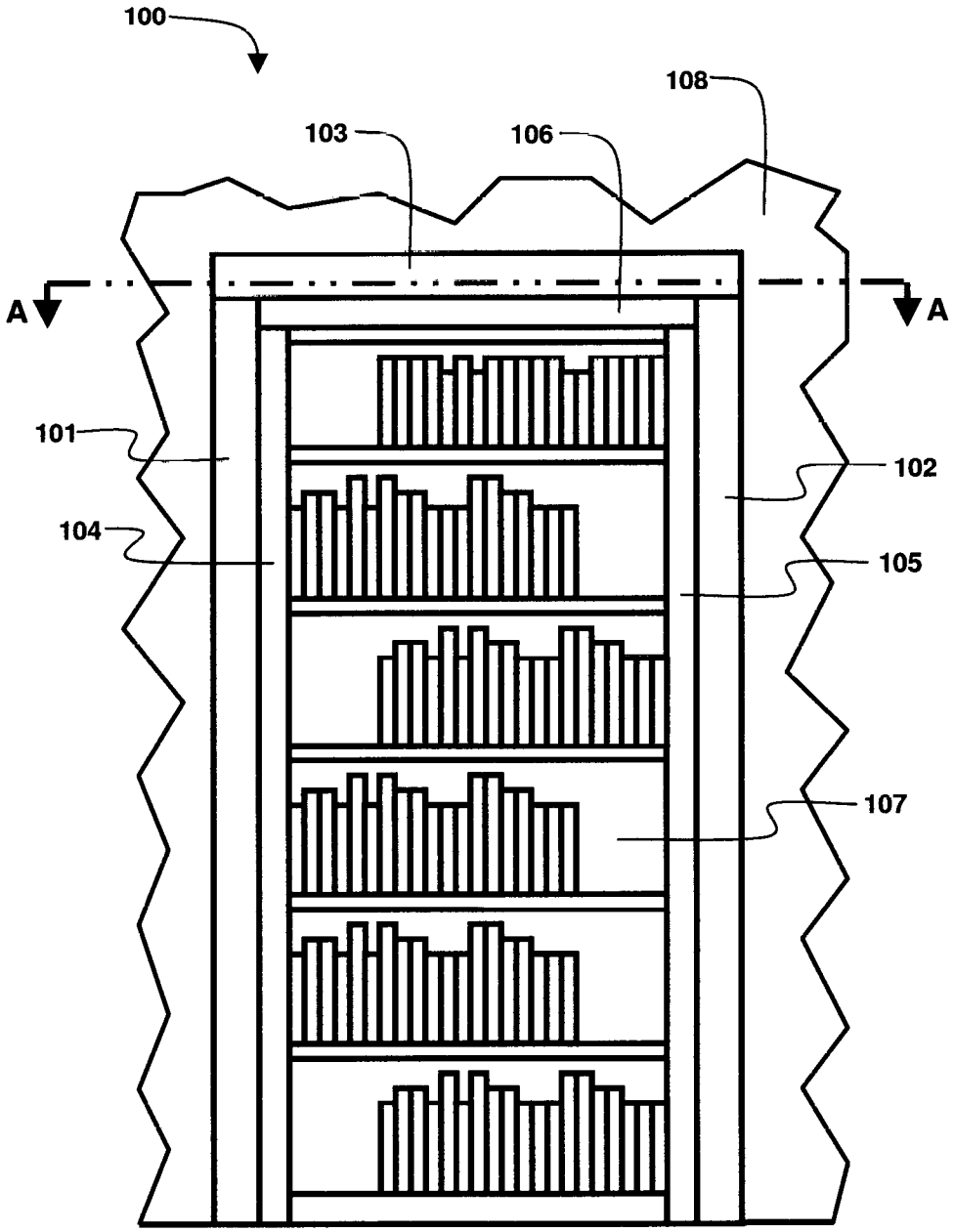
FIG. 1 shows a front view of a hidden hinge door mounted in an opening of a wall.

It should be understood that the drawings are not necessarily to scale. In certain instances, details that are not necessary for an understanding of the invention or that render other details difficult to perceive may have been omitted. It should be understood that the invention is not necessarily limited to the particular embodiments illustrated herein.

DETAILED DESCRIPTION

The ensuing description provides preferred exemplary embodiment(s) only, and is not intended to limit the scope, applicability or configuration of the disclosure. Rather, the ensuing description of the preferred exemplary embodiment (s) will provide those skilled in the art with an enabling description for implementing a preferred exemplary embodiment. It should be understood that various changes could be made in the function and arrangement of elements without departing from the spirit and scope as set forth in the appended claims.

Specific details are given in the following description to provide a thorough understanding of the embodiments. However, it will be understood by one of ordinary skill in the art that the embodiments may be practiced without these specific details. For example, shapes and geometries may be shown generically and details may be left out in order not to obscure the embodiments in unnecessary detail. When discussing a bookcase, as an example implementation in this disclosure, it is important to recognize that embodiments can include any article of furniture attached, built-in, or placed adjacent to a wall, that can be moved to reveal an opening in a wall, including just a heavy door that needs a hidden hinge. Thus examples of embodiments similar to bookcases can include built-in cabinets, drawers, shelves, holders (for items such as sports equipment, guns, pool cues, etc), mirrors, shoe storage, bulletin boards, artwork, electronic equipment, wine, displays, or any other type of furniture or related item capable of being understood by anyone skilled in the art.

In one embodiment, an out-swing hidden hinge door for use in residential and commercial buildings can comprise:

(a) a rigid metal frame suitable for holding a bookcase with horizontal shelves, the frame being adaptable to rectangular door openings of different heights;

(b) at least two hidden hinges, a first hidden hinge located near the top of the frame and a second hidden hinge located near the bottom of the frame;

(c) a means for mounting the hinges into a wall on either the right side or left side; and (d) means in the system for adjusting the location of the bookcase in six degrees of freedom, three mutually perpendicular linear axes, and three mutually perpendicular rotations.

The shelves could be user repositionable at different vertical locations to fit the different items to be placed on them. Each of the two hidden hinges can include a pair of interconnected four-bar linkages, further comprising a total of six links and seven pivot points (also known as revolute joints or prismatic joints), wherein the primary four-bar linkage rotates the frame forward from the wall and the secondary four-bar linkage, which shares two links with the primary four-bar linkage, facilitates the rotation of the hinge mechanism, attached frame, and bookcase about a virtual pivot point located forward from the wall about an arc that spans at least 90 degrees from a closed position to an open position. Ideally the linkages would be configured to rotate the frame and bookcase at least a value selected from the group of at least 120 degrees, at least 135 degrees, at least 150 degrees, at least 165 degrees, at least 175 degrees, and at least 180 degrees from the closed position to the open position. The hinges are hidden because each of the hinges is entirely behind the front face of the wall when the "door" is in its closed position.

In another embodiment, an in-swing hidden hinge door for use in a residential and commercial buildings can comprises the same adjustable rigid frame suitable for holding a bookcase as the out-swing embodiment. This in-swing embodiment can also incorporate two hinges, one located near the top of the frame and one located near the bottom of the frame, a means for mounting the hinges into the wall on either the right side or the left side, and a means in the system for adjusting the location of the bookcase in six degrees of freedom. In the embodiment for an in-swing configuration, the hinge mechanisms can be simpler than for an out-swing configuration if the pivot point is behind the back of the wall. Specifically, each hinge in the in-swing embodiment can use a single pivot point behind the back of the wall to rotate about the pivot point from a closed position backwards into the opening behind the wall about an arc that spans at least 90 degrees from a closed position to an open position. Ideally, the hinges would be configured to rotate the frame and bookcase at least a value selected from the group of at least 120 degrees, at least 135 degrees, at least 150 degrees, at least 165 degrees, at least 175 degrees, and at least 180 degrees from the closed position to the open position.

Referring now to the figures, FIG. 1 shows a hidden hinge door bookcase mounted in a wall at 100. The bookcase, shown at 107, has a left face frame, shown at 104, a right face frame, shown at 105, and a top face frame shown at 106. The left face frame 104, right face frame 105, and top face frame are at the front of the bookcase 104 and attached to the bookcase. The wall, shown at 108, surrounds the bookcase 107. The front of the wall 108 is in the same plane as the front of the left face frame 104, the right face frame 105, and the top face frame 106. There is a left case molding, shown at 101, a right case molding, shown at 102, and a top case molding 104 in front of the wall 108 that cover any gaps between the wall 108 and the left face frame 104, right face frame 105, and the top face frame 106. If this was not a hidden hinge door and the bookcase 107 was immovably attached to the wall 108, these three case moldings (101, 102, and 103) would be rigidly attached to the three face frames (104, 105, and 106). In a hidden hinge door bookcase, the three case moldings (101, 102, and 103) might be attached to either the wall 108, or the bookcase 107 (or attached face frames 104, 105, and 106), but the three case moldings (101, 102, and 103) would not be attached to both the wall and the bookcase 107 (or attached face frames 104, 105, and 106).

Figure 2A:
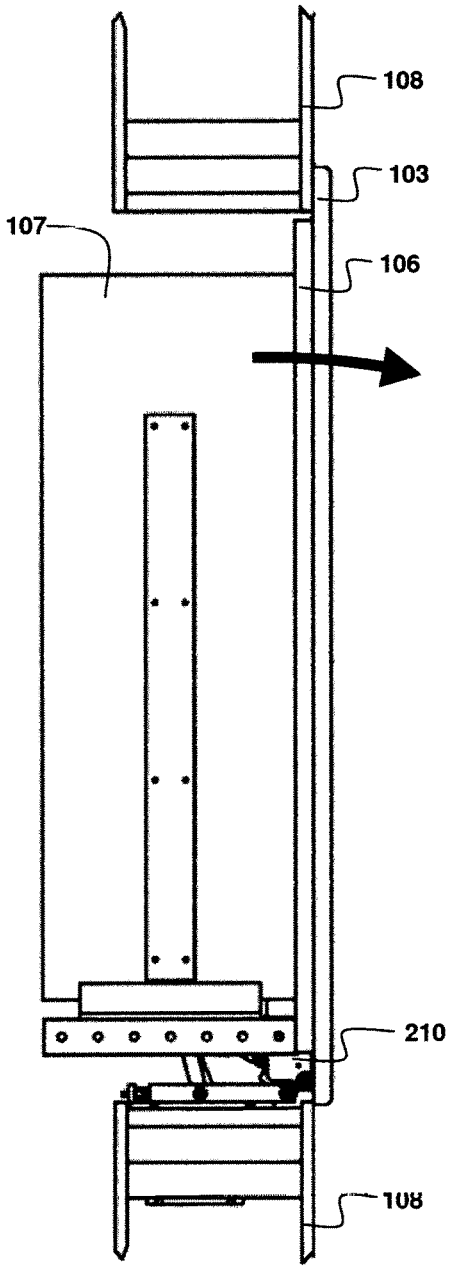
FIG. 2A shows an out-swing embodiment of the hidden hinge door of FIG. 1 when seen from the top of the wall opening (Section A-A in FIG. 1)
Figure 2B:
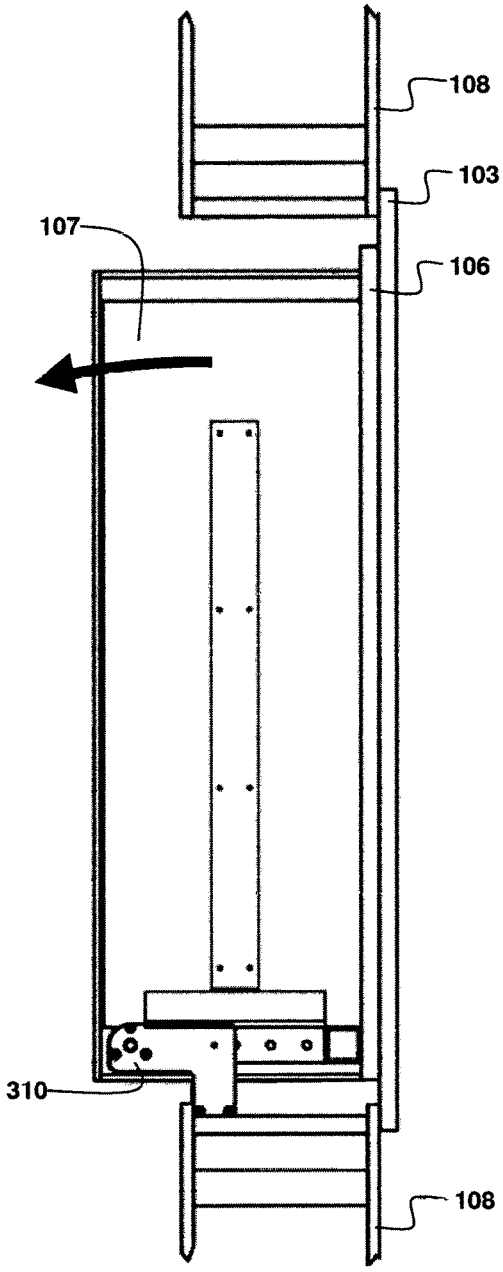
FIG. 2B shows an in-swing embodiment of the hidden hinge door of FIG. 1 when seen from the top of the wall opening (Section A-A in FIG. 1)

FIG. 2A shows a top view (Section A-A in FIG. 1) of an out-swing embodiment, of the hidden hinge door of FIG. 1. By out-swing, we mean that the bookcase, shown at 107, will rotate out from (in front of) the plane of the wall. FIG. 2B shows a top view (Section A-A in FIG. 1) of an in-swing embodiment, of the hidden hinge door. By in-swing, we mean that the bookcase, shown at 107, will rotate (move in) to a position behind the plane of the wall. Also shown in FIG. 2A and FIG. 2B are the wall, at 108, the top face frame, at 106, and the top case molding, at 103. The out-swing embodiment of the hidden hinge door uses a top out-swing hinge, shown at 210, and a bottom out-swing hinge that is not visible in this view. The in-swing embodiment of the hidden hinge door uses a top in-swing hinge, shown at 310 and a bottom in swing hinge that is not visible in this view. Note that for the out swing configuration, the top case molding 103 rotates with the door and for the in-swing configuration, the top case molding 103 stays fixed to the wall 108.

Figure 3:
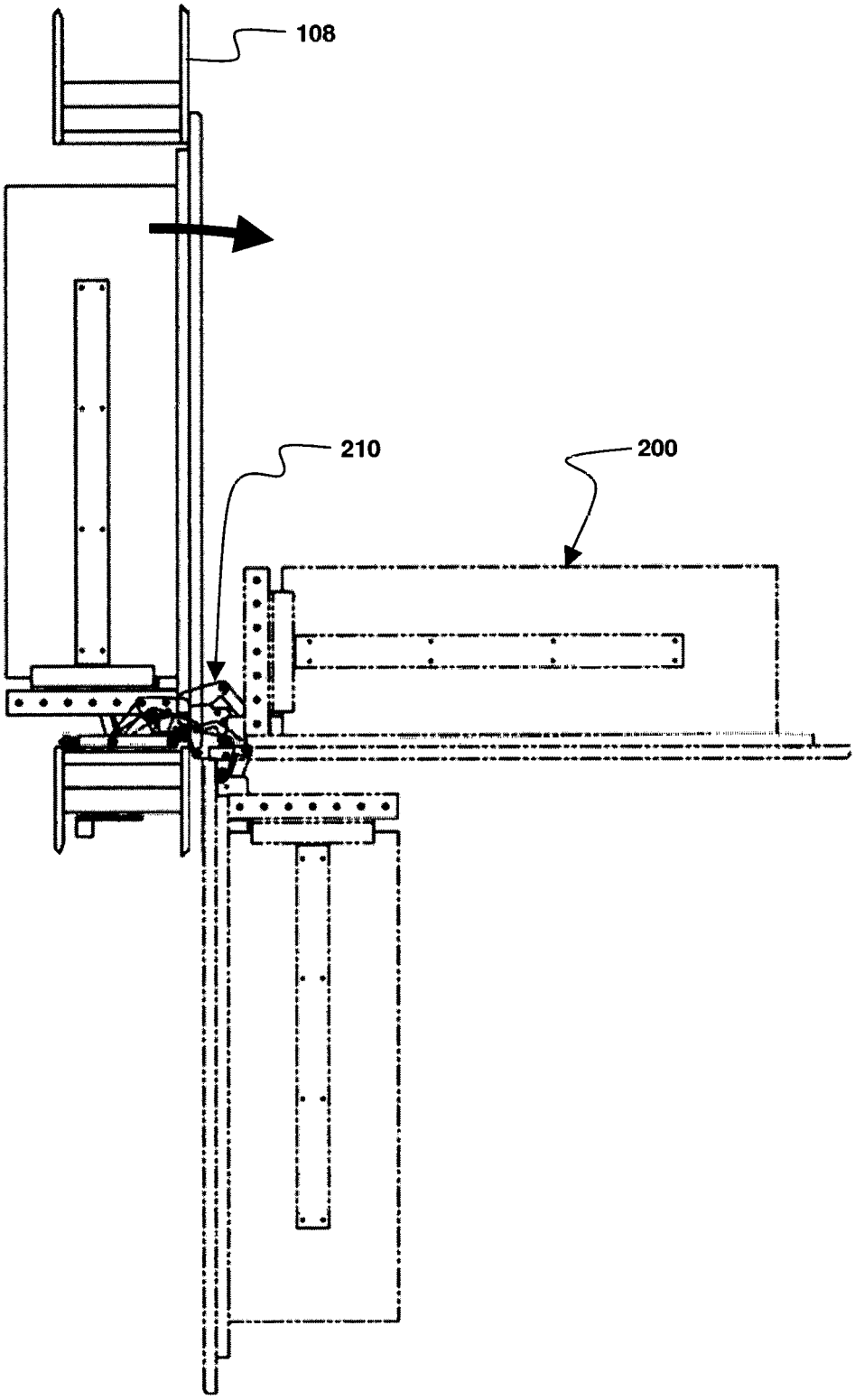
FIG. 3 shows the motion of the out-swing hidden hinge door of FIG. 2A at 0 degrees (fully closed), 90 degrees, and 180 degrees (fully open)

FIG. 3 shows the movement of the out-swing embodiment of the hidden hinge door mounted in a wall 108. The out-swing embodiment of the hidden hinge door comprises two modules, a top out-swing hinge assembly, shown at 210, and an out-swing bookcase door assembly shown at 200. There is also a bottom out-swing hinge assembly that is not visible in this view. As shown by FIG. 3, the top out-swing hinge assembly 210 and out-swing bookcase door assembly 200 are designed to allow the out-swing embodiment of the hidden hinge door to rotate through and arc of at least 90 degrees and ideally a full 180 degrees, allowing the out-swing embodiment of the hidden hinge door to almost completely move out of the opening in the wall 108. In the out-swing embodiment of the hidden hinge door, the left case molding, right case molding, and top case molding (visible at 101, 102, and 103 in FIG. 1 and FIG. 2A) are attached and rotate with the out-swing bookcase door assembly 200.

Figure 4:
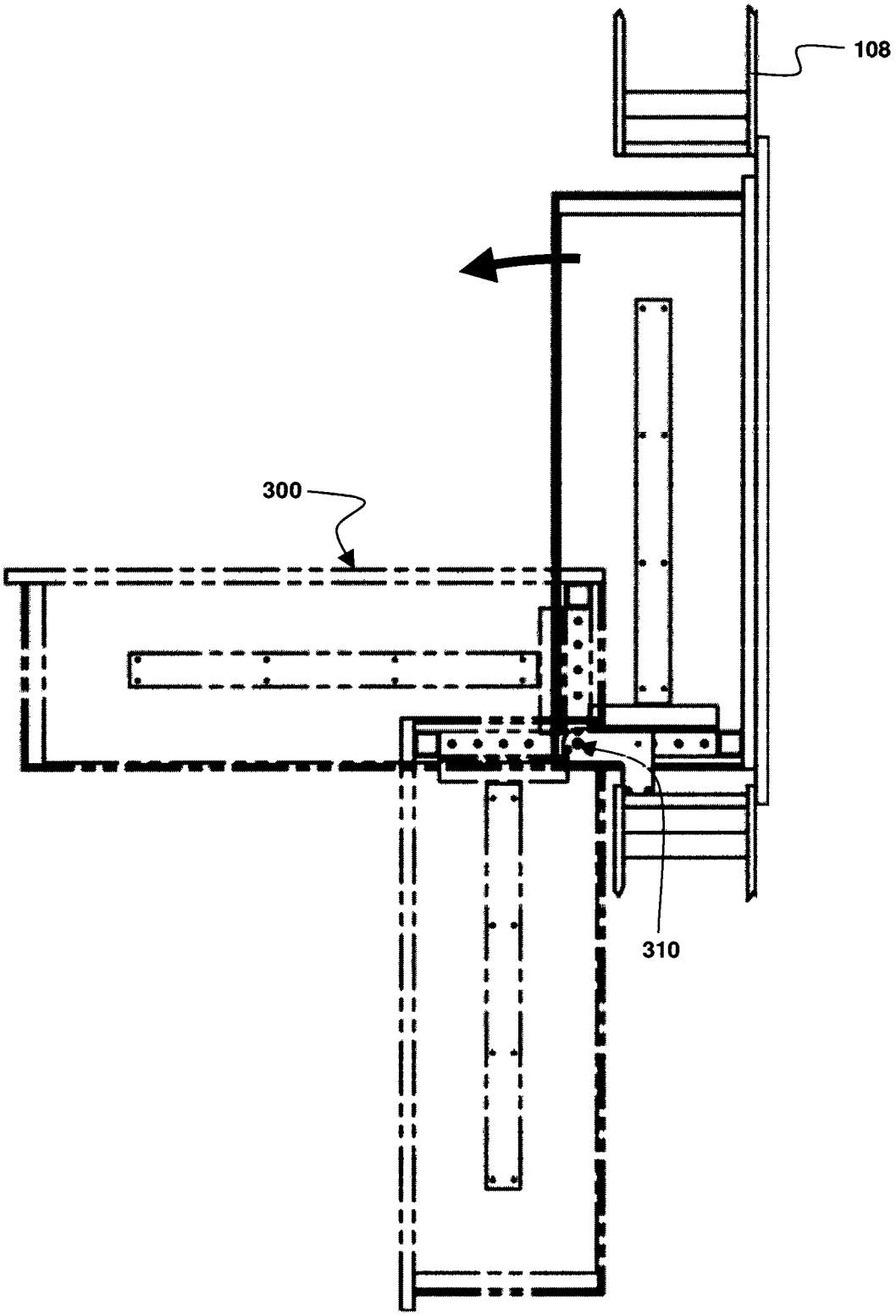
FIG. 4 shows the motion of the in-swing hidden hinge door of FIG. 2B at 0 degrees (fully closed), 90 degrees, and 180 degrees (fully open)

FIG. 4 shows the movement of the in-swing embodiment of the hidden hinge door mounted in a wall 108. The in-swing embodiment of the hidden hinge door comprises two modules, an in-swing hinge assembly, shown at 310, and an in-swing bookcase door assembly shown at 300. There is also a bottom in-swing hinge assembly that is not visible in this view. As shown by FIG. 4, the top in-swing hinge assembly 310 and in-swing bookcase door assembly 300 are designed to allow the in-swing embodiment of the hidden hinge door to rotate in an arc of at least 90 degrees and preferably a minimum of 180 degrees of rotation, allowing the in-swing embodiment of the hidden hinge door to almost completely move out of the opening in the wall 108. In the in-swing embodiment of the hidden hinge door, the left case molding, right case molding, and top case molding (visible at 101, 102, and 103 in FIG. 1 and FIG. 2A) are attached to the wall 108 and do not rotate with the in-swing bookcase door assembly 300.

Figure 5A:
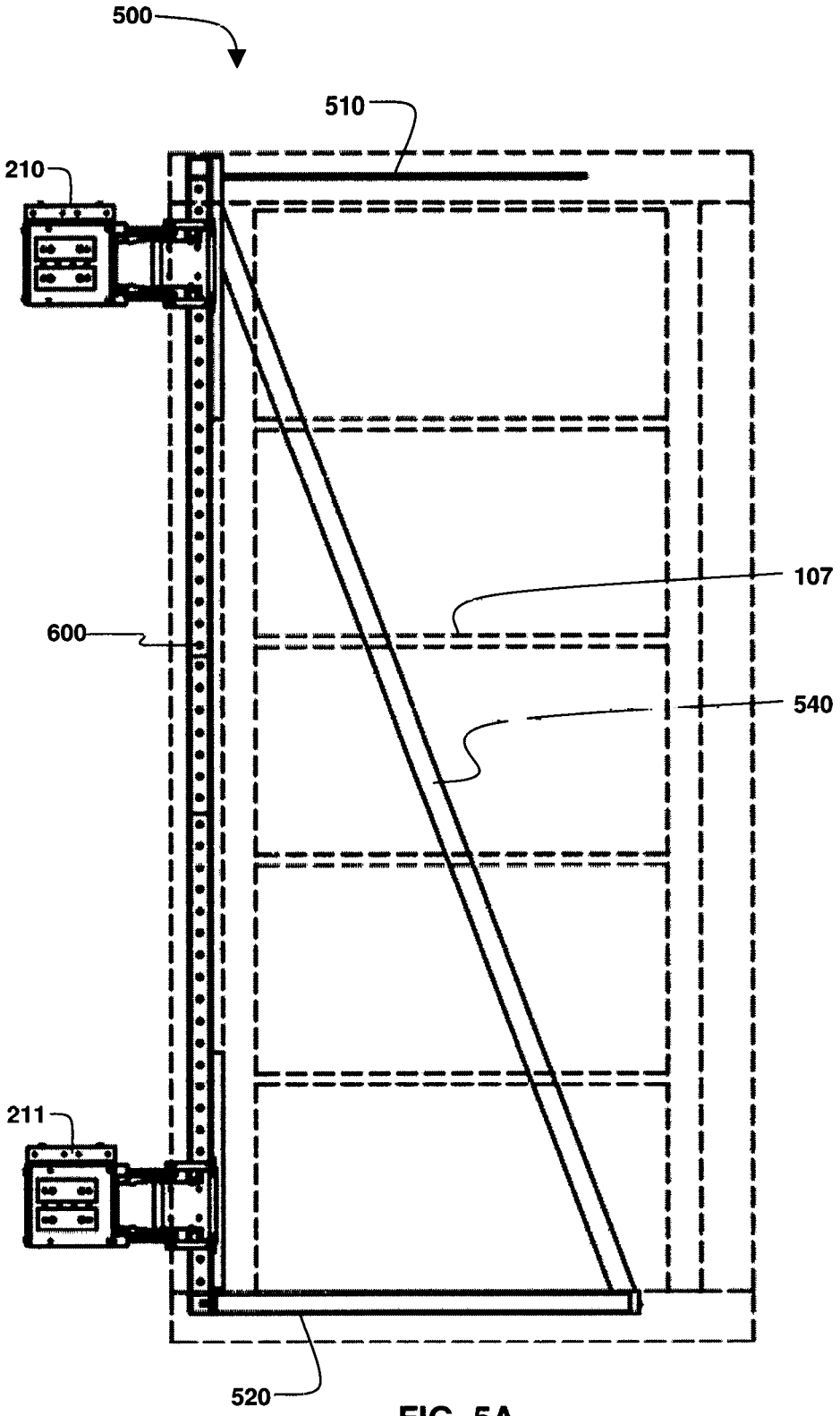
FIG. 5A shows a rear view of a frame assembly for a hidden hinge door.
Figure 5B:
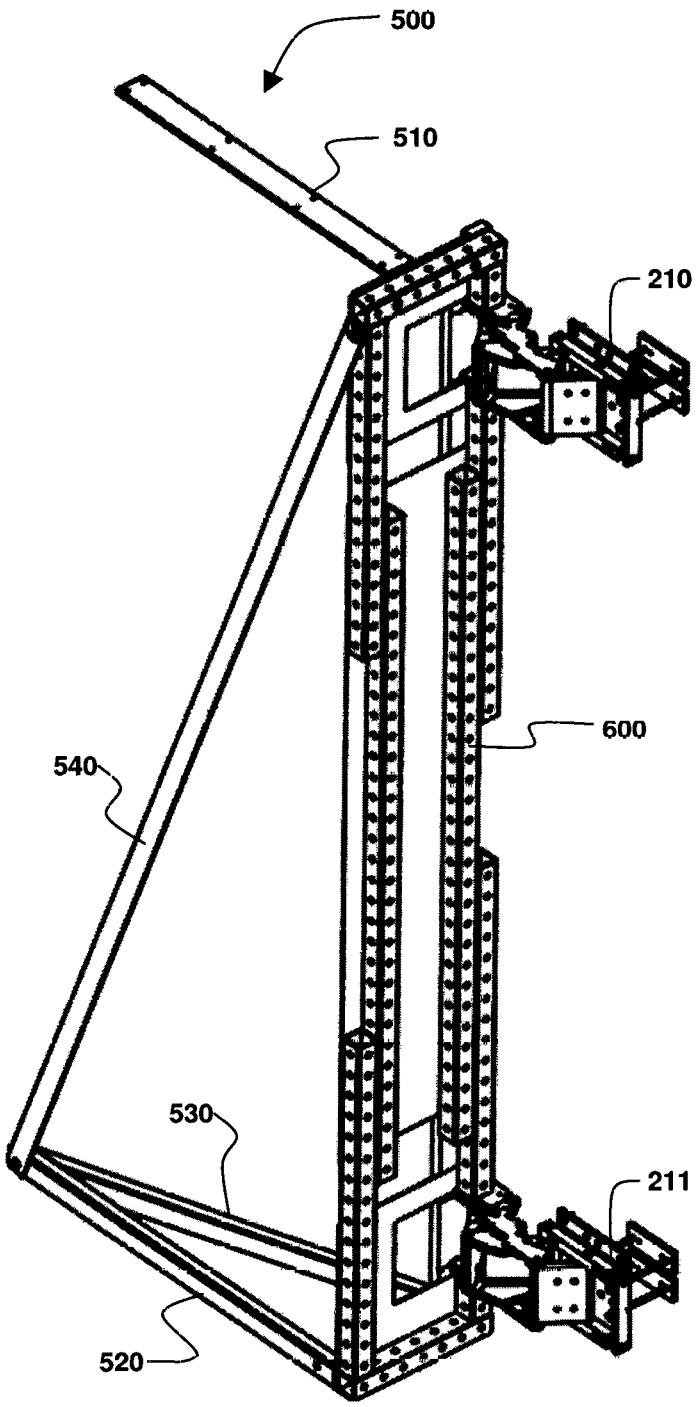
FIG. 5B shows an isometric view of a frame assembly for a hidden hinge door.

FIG. 5A shows a rear view of a frame assembly for hidden hinge door at 500. FIG. 5B shows an isometric view of the frame assembly for a hidden hinge door at 500. The frame assembly 500 in FIG. 5A and FIG. 5B comprises an adjustable height vertical frame, shown at 600, a bookcase top attachment member, shown at 510, a bookcase rear bottom attachment member, shown at 520, a bookcase rear diagonal brace, shown at 540, a top out-swing hinge assembly, shown at 210, and a bottom out-swing hinge assembly shown at 211. The bookcase top attachment member 510 comprises a slender horizontal element that is configured to attach to the top of the vertical section of the frame at one of its ends and to the top of the bookcase at its other end. The bookcase rear bottom attachment member 520 comprises a slender horizontal element that is configured to attach to the bottom of the vertical section of the frame at one of its ends and to the top of the bookcase at its other end. The rear diagonal brace 502 comprises a slender element that is configured to attach at a first end to a region of the rear bottom attachment member that is outboard from the vertical section of the frame and at a second end to a point on the vertical section of the frame that is above the point at which the bottom attachment member 520 is attached to the vertical section, which provides a triangular configuration for helping to support the load of the bookcase or other article of furniture placed in the frame assembly. The top out-swing hinge assembly 210 attaches near the top of the vertical frame 600. The bottom out-swing hinge assembly 211 attaches near the bottom of the vertical frame 600.

FIG. 5A also shows the bookcase 107 using hidden lines. FIG. 5B also shows a bookcase diagonal bottom attachment member, at 530. The bookcase 107 (or any other article placed in the frame) can be adjusted side-to-side by sliding the bookcase 107 laterally on the rear bottom attachment member 520 and diagonal bottom attachment member 530. For example, the rear bottom attachment member 520 could be made of angle iron that is oriented in a way to provide a lip on which he bookcase can rest and a vertical feature that the back of the bookcase 107 can rest against. The rear bottom attachment member 520, the diagonal bottom attachment member 530, and/or the top attachment member 510 could also have screw holes for screws to securely attach the bookcase to one or more of 520, 530, or 510.

Figure 6A:
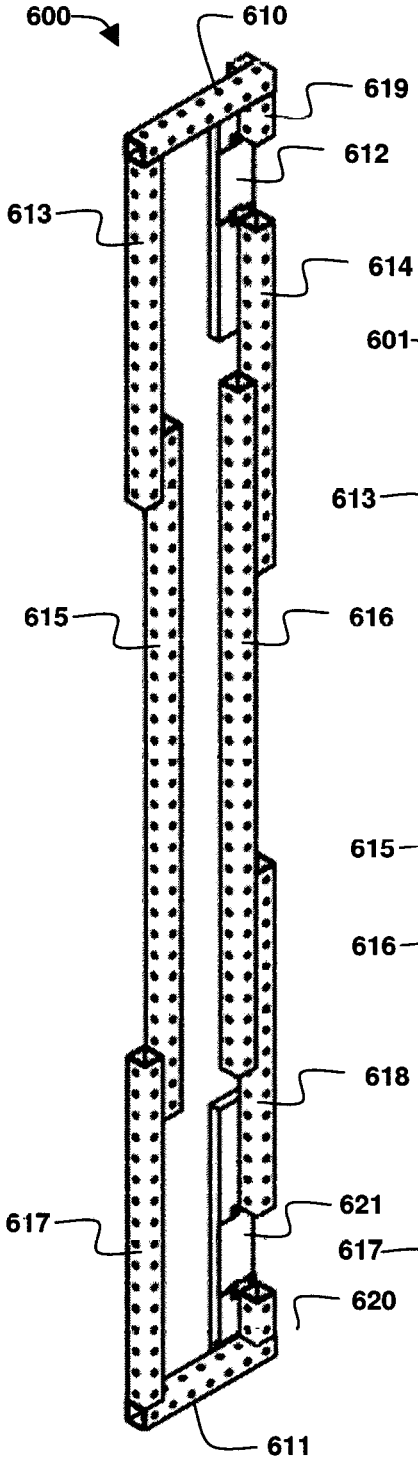
FIG. 6A shows an adjustable height vertical frame comprising pre-machined square tubing, when assembled for a tall door opening.
Figure 6B:
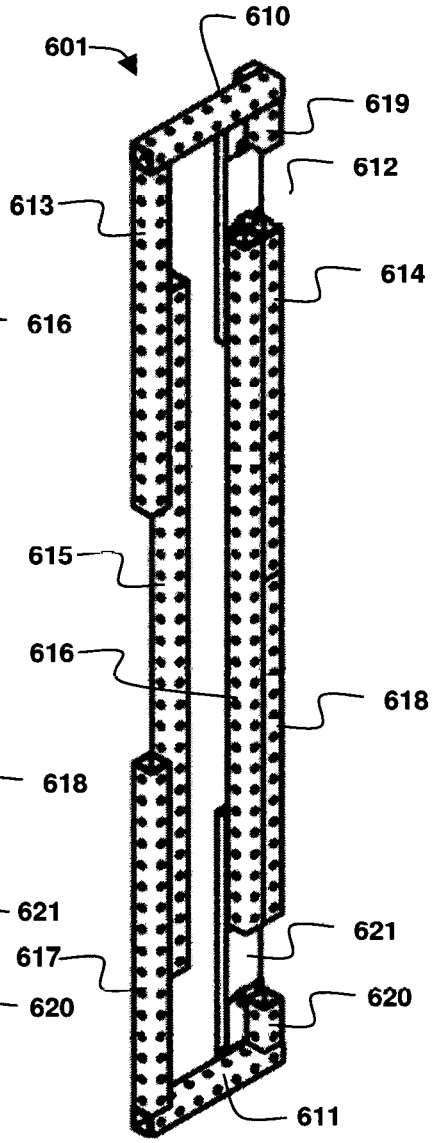
FIG. 6B shows the adjustable height vertical frame of FIG. 6A when assembled for a short door opening.

FIG. 6A shows the adjustable height vertical frame of FIG. 5A and FIG. 5B, when assembled for a tall door opening at 600. FIG. 6B shows the same adjustable height vertical frame when assembled for a short door opening, at 601. The adjustable frames shown at 600 and 601 are comprised of a set of pieces of pre-machined square tubing, shown at 610, 611, 613, 614, 615, 616, 617, 618, 619, and 620. There are also two frame stiffeners, a top frame stiffener shown at 612 and a bottom frame stiffener shown at 621, which are made from flat metal bar stock. Referring to the pieces of pre-machined square tubing (610, 611, 613, 614, 615, 616, 617, 618, 619, and 620), in one embodiment these can be cut pieces of HT Series™ standard aluminum framing material with regularly-spaced holes that can be purchased through a company called 80/20™ Inc, and is referred to as an "industrial erector set." By using such industrial erector set materials, it becomes easy and fast to make a frame of any height and to change from a tall adjustable height vertical frame (600 in FIG. 6A) to a short adjustable height vertical frame (601 in FIG. 6B). The adjustable vertical frame could be made out of any material in any configuration capable of being understood by anyone skilled in the art. Examples of materials might include metal, wood, and plastics. Examples of shapes, other than pre-machined square tubing can include round tubing, bar stock, angle iron, and I-beams. The shapes for 610, 611, 613, 614, 615, 616, 617, 618, 619, and 620 do not necessarily need to be pre-machined. Creation of these shapes can include extrusion, rolling, bending, and many other forming technologies capable of being understood by anyone skilled in the art.

Further referring to FIG. 6A and FIG. 6B, the specific names of the components shown include: a horizontal top frame element shown at 610; a horizontal bottom frame element shown at 611; a first vertical top frame element shown at 613; a second vertical top frame element shown at 614; a first vertical mid frame element shown at 615; a second vertical mid frame element shown at 616; a first vertical bottom frame element shown at 617; a second vertical bottom frame element shown at 618; a top frame stiffener adapter shown at 619; and a bottom frame stiffener adapter shown at 620.

Figure 7:
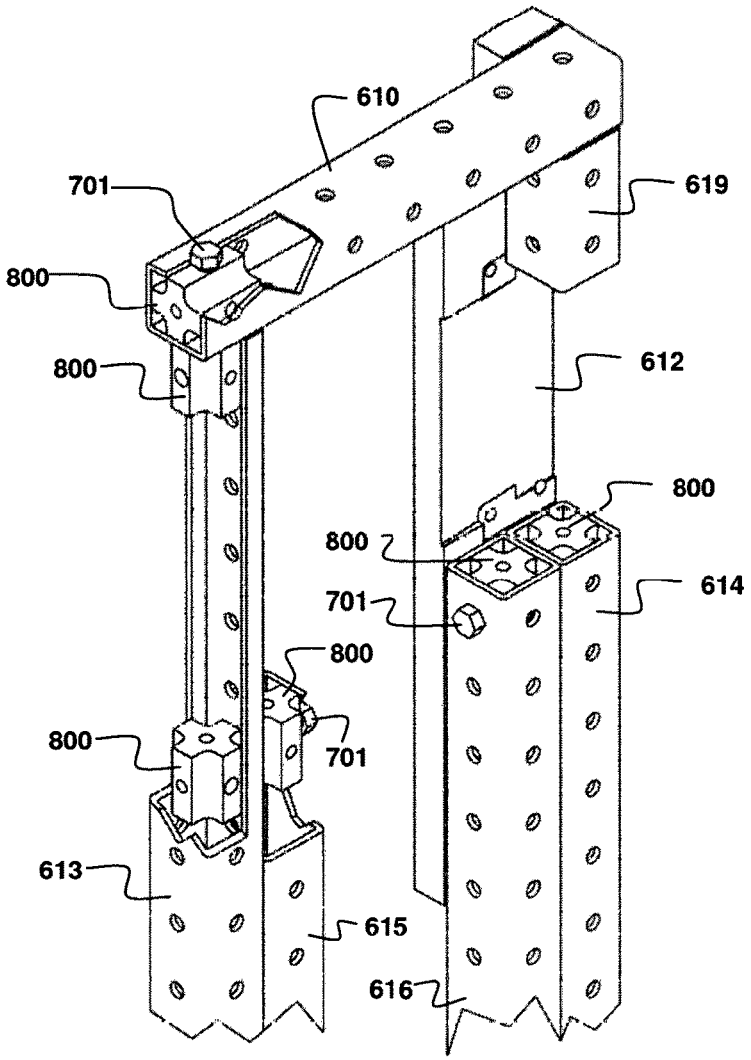
FIG. 7 shows a cutaway of the top of the adjustable height vertical frame of FIG. 6B.

FIG. 7 shows a cutaway of the top of the adjustable height vertical frame of FIG. 6B. This cutaway view illustrates how the adjustable height vertical frame is assembled. The horizontal top frame element 610, the first vertical top frame element 613, the second vertical top frame element 614, the first vertical mid frame element 615, the second vertical mid frame element 616, and the top frame stiffener adapter that were previously shown with reference to FIG. 6A and FIG. 6B, are connected together using pre-machined square tubing adapters, shown at 800, and frame bolts, shown at 701. The square tubing adapters 800 fit into the horizontal and vertical frame elements. The frame bolts 701 go through the holes on the sides of the horizontal and vertical frame elements and then thread into tapped holes located in the square tubing connectors. In some cases, the frame bolts go through the drilled holes of one square tubing connector 800 and then screw into the threaded hole of a second tubing connector 800 that is located in an adjacent frame element. One example of a pre machined square tubing connector is the "4600N 5/16-18 aluminum standard tube insert" sold by 80/20(trademark) Inc of Columbia City, Ind. (http://8020.net) that is designed to fit inside of their 1.5 inch×1.5 inch aluminum square tube profiles (part number 9701).

Figure 8A:
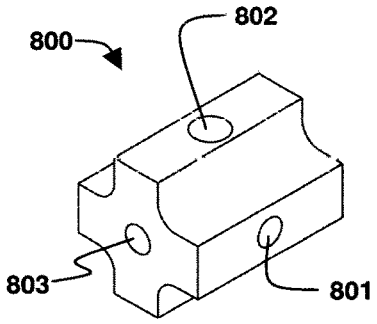
FIG. 8A shows an pre-machined square tubing connector that can be used to secure the pre-machined square tubing in the adjustable height vertical frame of FIG. 6A, FIG. 6B and FIG. 7.
Figure 8B:
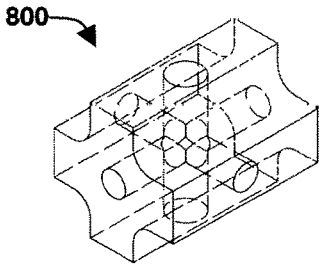
FIG. 8B shows the pre-machined square tubing connector of FIG. 8A with hidden lines to reveal through holes.

FIG. 8A shows how a pre-machined square tubing connector 800 (4600N connector) can he used to secure the pre-machined square tubing in the adjustable height vertical frame of FIG. 5A, FIG. 5B, FIG. 6A, FIG. 6B and FIG. 7. FIG. 8B shows the pre-machined square tubing connector of FIG. 8A with hidden lines to reveal through holes. Referring to FIG. 8A, the tubing connector 800 comprises three orthogonal holes that intersect: one of the transverse holes, shown at 801, is a threaded hole. Another of the transverse holes, shown at 802 is a drilled hole, which allows a bolt that could be threaded in a hole similar to 801 to pass through it. The longitudinal hole, shown at 803 is a threaded hole with the same dimensions as the transverse threaded hole.

FIG. 9A shows an isometric view of the out-swing bottom hinge module 211 and a section of the frame in the 0 degree (closed) position. FIG. 9B shows an isometric view of the out-swing bottom hinge module 211 and a section of the frame in the 90 degree (half open) position. FIG. 9C shows an isometric view of the out-swing bottom hinge module in the 180 degree (fully open) position. These three drawings illustrate the motion of the elements of the bottom hinge module 210 through a 180-degree arc. The top hinge module (not shown), that is located near the top of the frame, is a mirror image of this bottom hinge module 211. It is also possible to have embodiments of the invention with additional hinge modules located between the top hinge module and the bottom hinge module 211.

Figure 10:
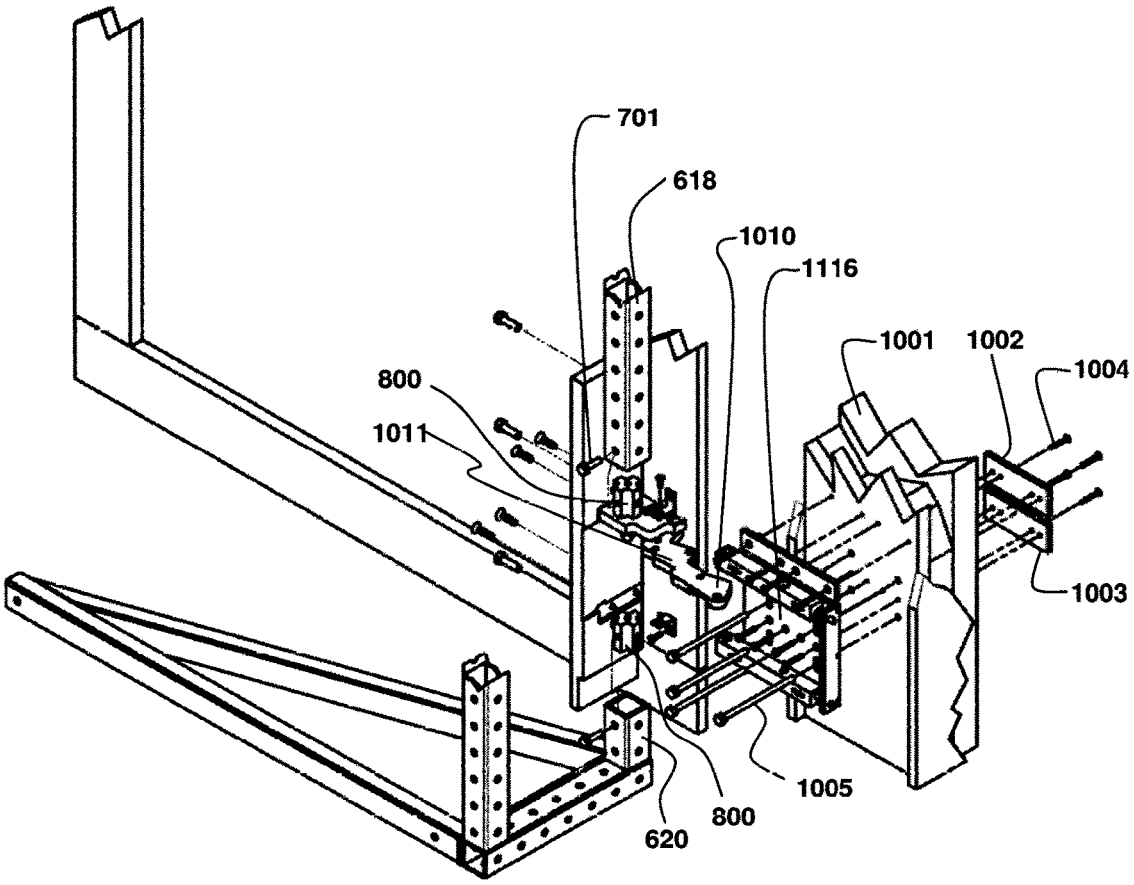
FIG. 10 shows an exploded view of the assembly shown in FIG. 9B.

FIG. 10 shows an exploded view of parts of the assembly that was shown in FIG. 9A, FIG. 9B, and FIG. 9C. FIG. 10 illustrates how a hinge assembly (in this case a bottom hinge assembly) can be attached to the vertical stud (commonly called a king stud) of a wall and how the hinge assembly can be attached to the frame assembly. In FIG. 10, the main elements of the actual hinge assembly are not shown in order to focus on the attachment elements of the hinge assembly and how they attach to adjoining parts of the system, but these missing parts can be seen in FIG. 11. Referring to FIG. 10, a king stud is shown at 1001. The king stud 1001 could be made out of a single vertical frame member (typically wood) or it could be made of multiple layers of wood, such as the configuration shown at 1001. A first nut plate 1002 and a second nut plate 1003 can be located on the side of the king stud 1001 that is opposite the hinge assembly. The first nut plate 1002 and the second nut plate 1003 may be fastened to the king stud using wood screws, shown at 1004. In the configuration shown in FIG. 10, there are four holes in each of the nut plates. Two of these holes are for the wood screws 1004, and two are for king stud bolts, shown at 1005. The king stud bolts 1005 go through the hinge base plate 1116, then the king stud 1001 and are then threaded into the nut plates 1002 and 1003. The configuration shown in FIG. 10 can be used for attaching the top hinge or the bottom hinge to a king stud. The configuration shown in FIG. 10 can be used for attaching the top hinge to a top region of the vertical frame and the bottom hinge to a bottom hinge of the vertical frame. In other embodiments, the nut plates 1002 and 1003 could be replaced with standard nuts and washers, capable of being understood by anyone skilled in the art. Nut plates 1002 and 1003 were used in the embodiment shown because they facilitate adjustment of the hinge assembly after the nuts (on the nut plates 1002 and 1003) are concealed inside the wall. Due to possible alignment issues with the drilling of the king stud 1001, the nut plate or plates 1002/1003 may be modified to use more plates with one threaded hole per plate.

FIG. 10 also shows how the upper second arm 1010 (of the hinge assembly) connects to the upper frame adapter 1011 (of the hinge assembly), which in turn connects to a tubing connector 800 (previously shown in FIG. 7, FIG. 8A, and FIG. 8B) that is mounted inside the second vertical bottom frame element 618 (previously shown in FIG. 6A and FIG. 6B) using a frame bolt 701 (previously shown in FIG. 7). In the same way, the lower second arm and lower frame adapter (not shown) are attached to a tubing connector 800 that is mounted inside the bottom frame stiffener adapter 620.

Figure 11:
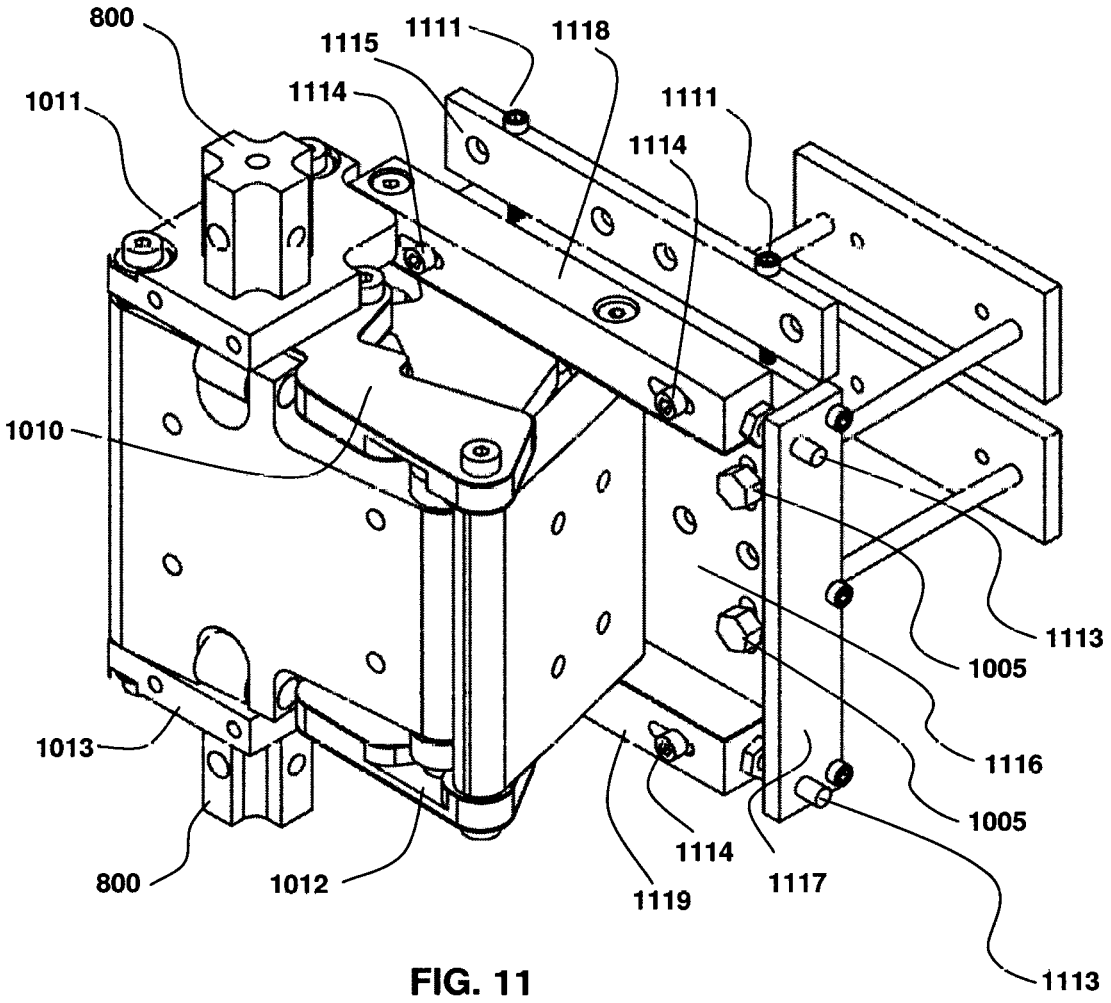
FIG. 11 shows more detail of the hinge mechanism for the frame assembly shown in previous figures, with the hinge in the closed (0 degree) position.

FIG. 11 shows more detail of the hinge mechanism for the frame assembly shown in previous figures, with the hinge in the closed (0 degree) position and illustrates how the bookcase can be adjusted in the y-axis (vertically) and in the z-axis (in and out of the wall opening) by adjusting the hinge relative to the mounting holes in the vertical studs (typically called king studs) in the wall. Referring to FIG. 11, there is a vertical alignment (or adjustment) member, shown at 1115. This vertical alignment member 1115 can be screwed into the door jamb, which is attached in front of the king studs of the wall before any other components are mounted in the wall. The vertical alignment member 1115 has two vertical holes for placement of a pair of vertical hinge adjustment bolts, shown at 1111. The vertical hinge adjustment bolts screw into the hinge base plate, shown at 1116, and allow the hinge base plate 1116 to move up and down when the vertical hinge adjustment bolts 1111 are turned. Once the correct vertical position for the hinges, and therefore the bookcase in the frame, have been determined, the king stud bolts, shown at 1005, can be tightened in the slots of the hinge base plate 1116.

Further referring to FIG. 11, adjustment of the bookcase in the z-axis (in and out of the wall opening) is accomplished by use of the horizontal hinge adjustment bolts, shown at 1113. When the horizontal hinge adjustment bolts 1113 are rotated in the vertical hinge base plate element, shown at 1117, the top hinge base bar, shown at 1118, and the bottom hinge base bar, shown at 1119, move horizontally relative to the hinge base plate. Once the correct, in-out (z axis) location has been set, the upper hinge base bar 1118 and the lower hinge base bar 1119 can be secured to the hinge base plate 1116 by tightening the hinge base mounting bolts, shown at 1114. Pitch of the bookcase (i.e. rotation of the bookcase about a horizontal axis) can be accomplished with these same horizontal hinge bolts 1113 by moving the bookcase in at the top hinge and out at the bottom hinge, or vice versa. Also shown in FIG. 11 are the upper second arm 1010, the upper frame adapter 1011, the lower second arm 1012, the lower frame adapter 1013 and two pre-machined square tubing connectors 800 that were previously referred to in FIG. 10.

Figure 12:
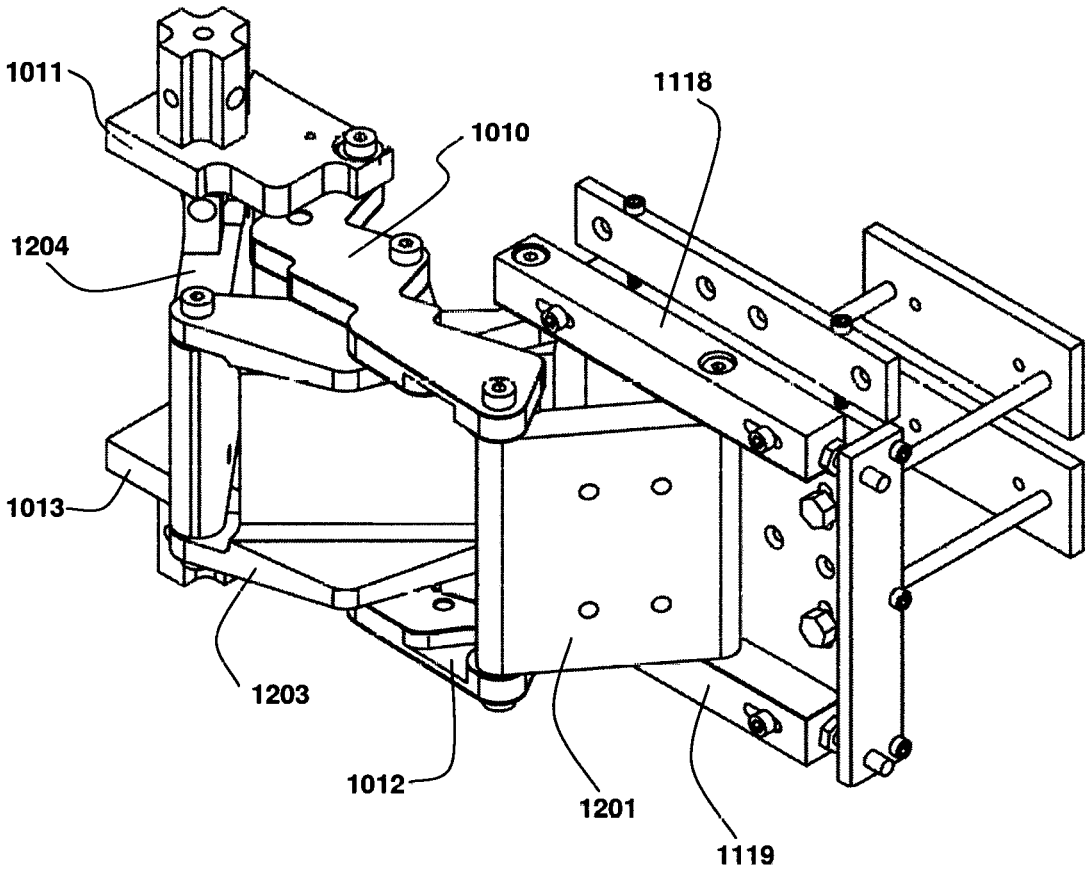
FIG. 12 shows more detail of the hinge mechanism for the frame assembly shown in previous figures, with the hinge in the open (180 degree) position.
Figure 13:
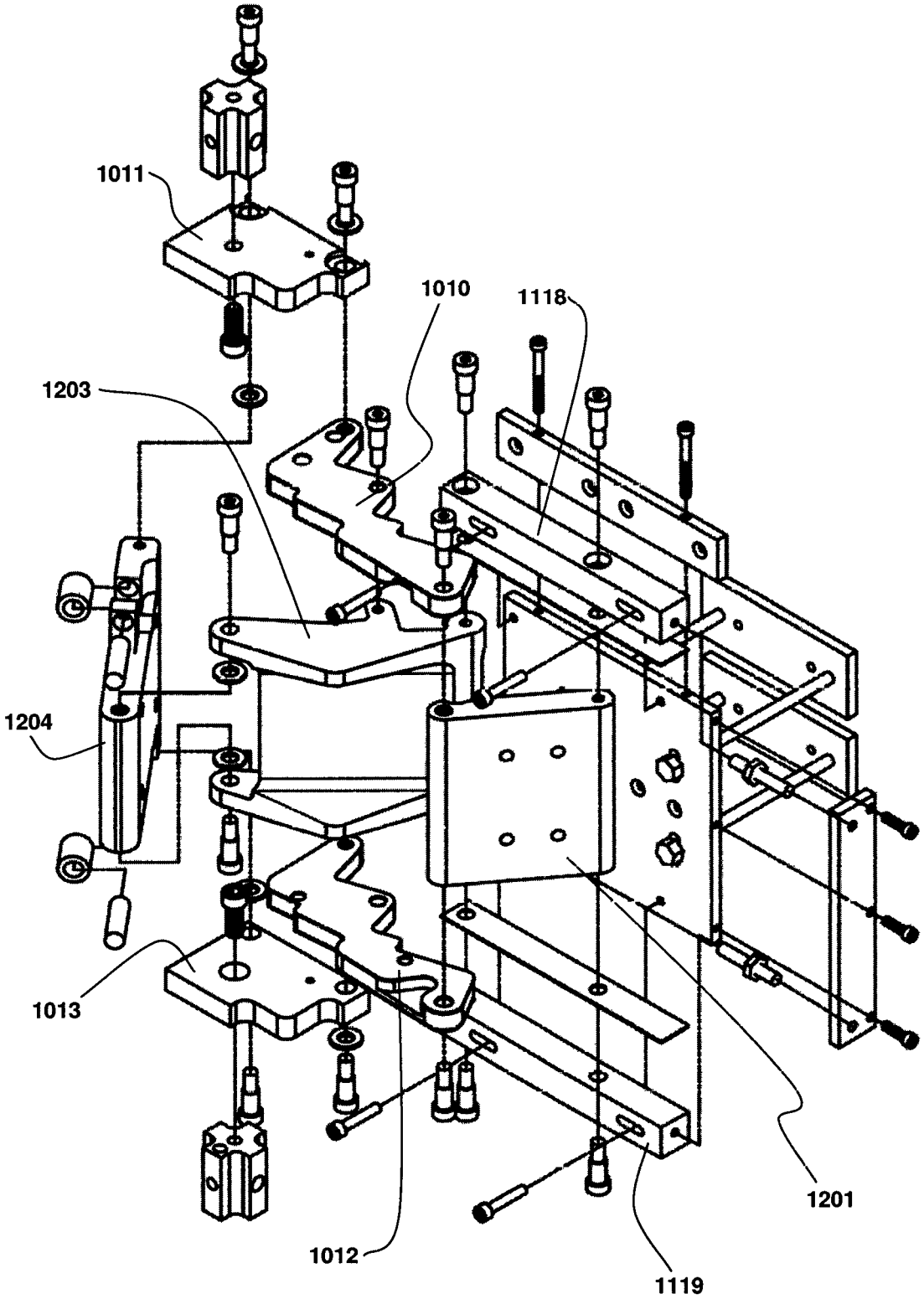
FIG. 13 shows an exploded view of the hinge mechanism shown in FIG. 12.

FIG. 12 provides more detail of the hinge mechanism for the frame assembly shown in previous figures, with the hinge in the open (180 degree) position. FIG. 13 shows an exploded view of the hinge mechanism shown in FIG. 12. Referring to FIG. 12 and FIG. 13, the upper hinge base bar 1118, the lower hinge base bar 1119, the first arm 1201, the upper second arm 1010, the lower second arm 1012, the third arm 1203, the fourth arm 1204, the upper frame adapter 1011, and the lower frame adapter 1013, together form a pair of interconnected four-bar linkages comprising a primary four bar linkage, a secondary four bar linkage, and six links.

Figure 14A:
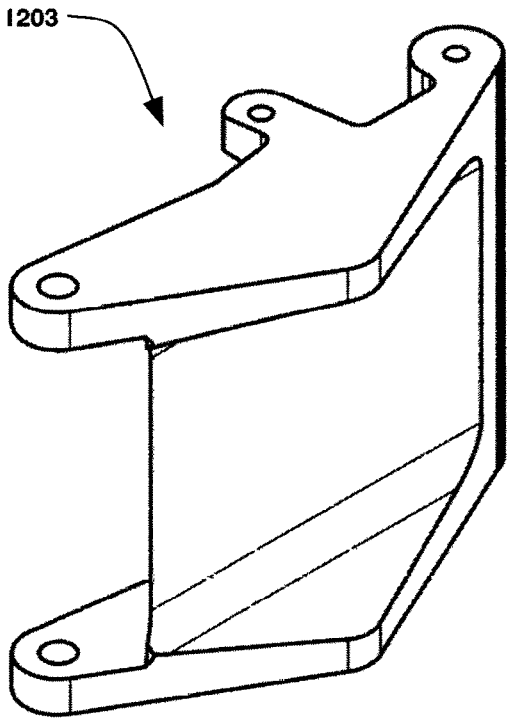
FIG. 14A shows a first isometric view of Arm 3 in FIG. 12.
Figure 14B:
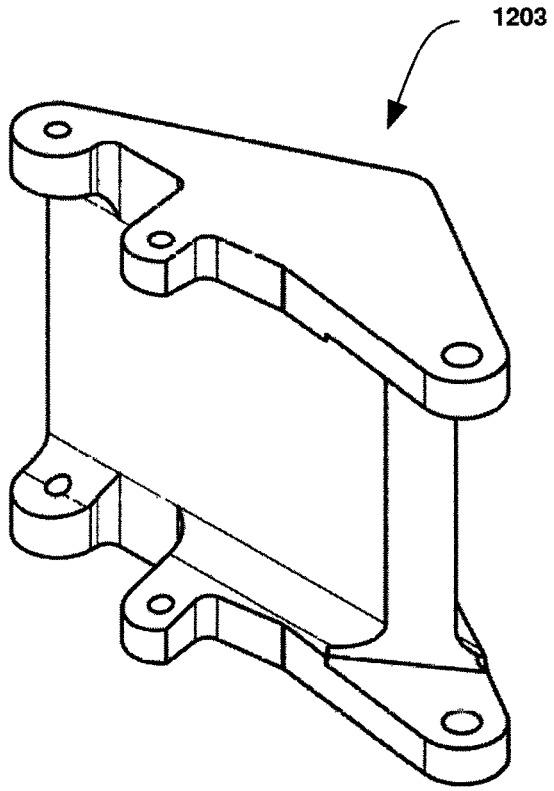
FIG. 14B shows a second isometric view of Arm 3 in FIG. 12.

FIG. 14A shows a first isometric view of the third arm 1203, that was also shown and discussed with reference to FIG. 12 and FIG. 13. FIG. 14B shows a second isometric view the third arm 1203, that was also shown and discussed with reference to FIG. 12 and FIG. 13.

Figure 15A:
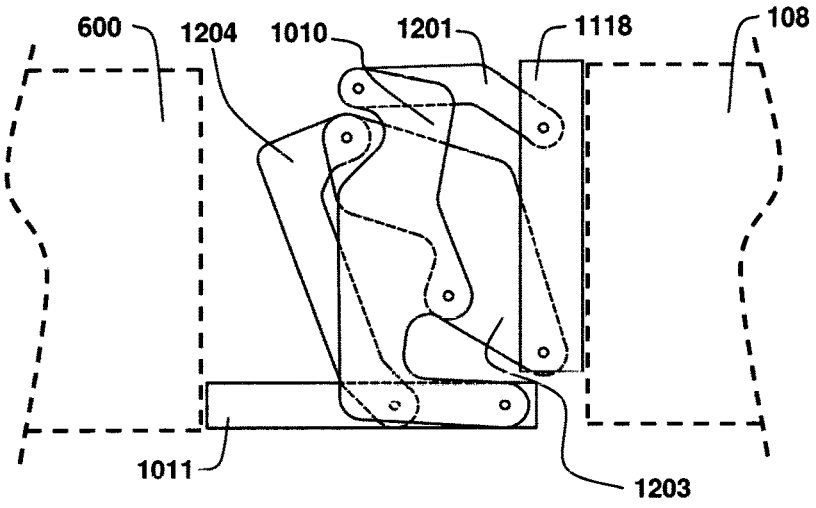
FIG. 15A shows a schematic of how the hinge mechanism works with the hinge in the closed (0 degree) position.
Figure 15B:
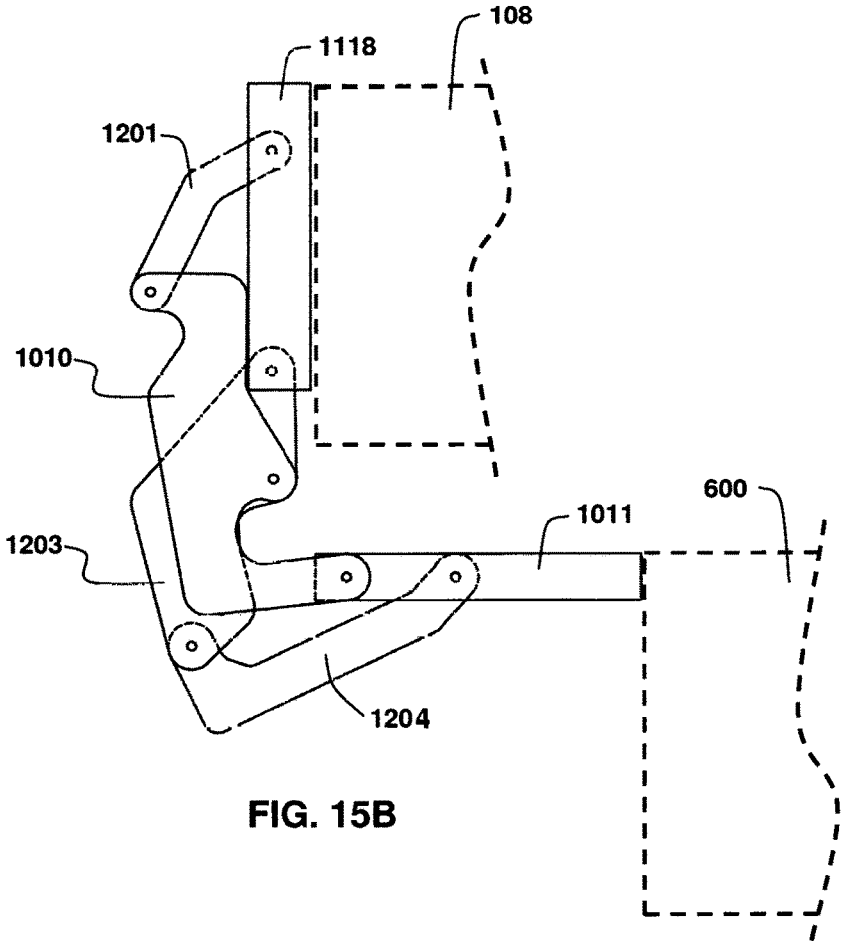
FIG. 15B shows the hinge mechanism schematic of FIG. 14A in the open (180 degree) position.

FIG. 15A shows a schematic of how the hinge mechanism works with the hinge in the closed (0 degree) position. FIG. 15B shows the hinge mechanism schematic of FIG. 15A in the open (180 degree) position. In the embodiments shown in FIG. 15A and FIG. 15B, the wall is shown at 108 and the vertical frame is shown conceptually at 600. The hinge mechanism sits between the wall 108 and the vertical frame 600. In the closed (0 degree) position, the entire hinge mechanism sits behind the front face of the wall. When the vertical frame 600 is rotated, it moves in front of the wall 108 about a virtual pivot point that is in front of the wall 108. The base bar 1118, first arm 1201, second arm 1010, and third arm 1203 constitute a first four-bar linkage that operates the same way as 1118, 1201, 1010 and 1203 in FIG. 12. The second four bar linkage consists of the second arm 1010, the third arm 1203, the fourth arm 1204, and the frame adapter 1011. The first and the second four bar linkages share two links: the second arm 1010 and the third arm 1203. Together, the two interconnected four-bar linkages have a total of six links. Note that there are seven pivot points. One of the pivot points is shared.

Figure 16A:
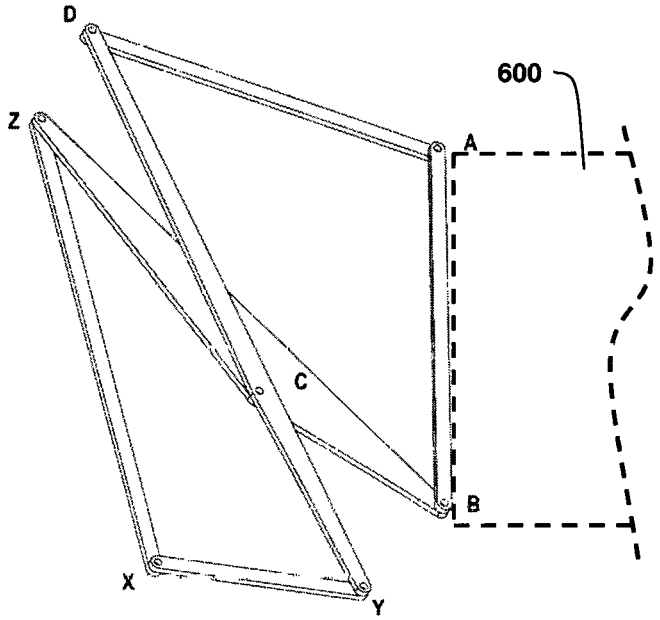
FIG. 16A shows a more conceptual schematic of the hinge mechanism of FIG. 14, which clarifies that this is a 4-bar linkage with follower.
Figure 16B:
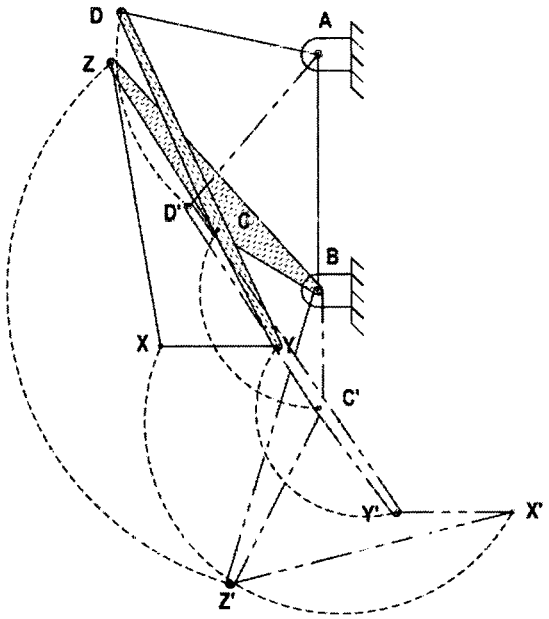
FIG. 16B shows the motion of the 4-bar linkage with follower of FIG. 15A as it rotates through a 180 degree arc.

FIG. 16A shows a more conceptual schematic of the hinge mechanism of FIG. 15A and FIG. 15B, which clarifies that the hinge mechanism is a pair of interconnected four-bar linkages comprising a total of six links, wherein the primary four-bar linkage rotates the frame forward from the wall and the secondary four-bar linkage, which shares two links with the primary four-bar linkage, facilitates the rotation of the region near the top of the vertical structure about an arc that spans more than 90 degrees from a closed position to an open position. To further clarify how the hinge mechanism shown in FIG. 16A (and other previous figures) works, FIG. 16B shows the motion of this pair of interconnected four-bar linkages comprising a total of six links. In particular, FIG. 16B illustrates that the segment XY (in the closed position) rotates through an arc of 180 degrees to the position shown at X'Y' (the open position).

Comparing the links in FIG. 16A and FIG. 16B with those in FIG. 15A and FIG. 16B, the adjustable height vertical frame is shown conceptually at 600 in FIG. 15A. The link A-B in FIG. 16A and FIG. 16B is he same as the base bar 1118 in FIG. 15A and FIG. 15B. The link A-D in FIG. 16A and FIG. 16B is he same as the first arm 1201 in FIG. 15A and FIG. 15B. The link D-C-Y in FIG. 16A and FIG. 16B is he same as the second arm 1010 in FIG. 15A and FIG. 15B. The link B-C-Z in FIG. 16A and FIG. 16B is he same as the third arm 1203 in FIG. 15A and FIG. 15B. The link Z-X in FIG. 16A and FIG. 16B is he same as the fourth arm 1204 in FIG. 15A and FIG. 15B. The link X-Y in FIG. 16A and FIG. 16B is he same as the frame adapter 1011 in FIG. 15A and FIG. 15B. The shared pivot point is at point C in FIG. 16A and FIG. 16B.

Figure 17C:
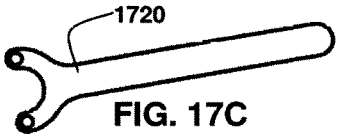
FIG. 17C and FIG. 17D show two views of a roll adjustment wrench.
Figure 17D:
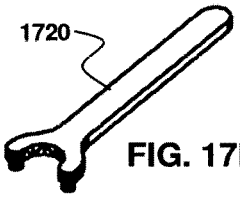
Figure 17A:
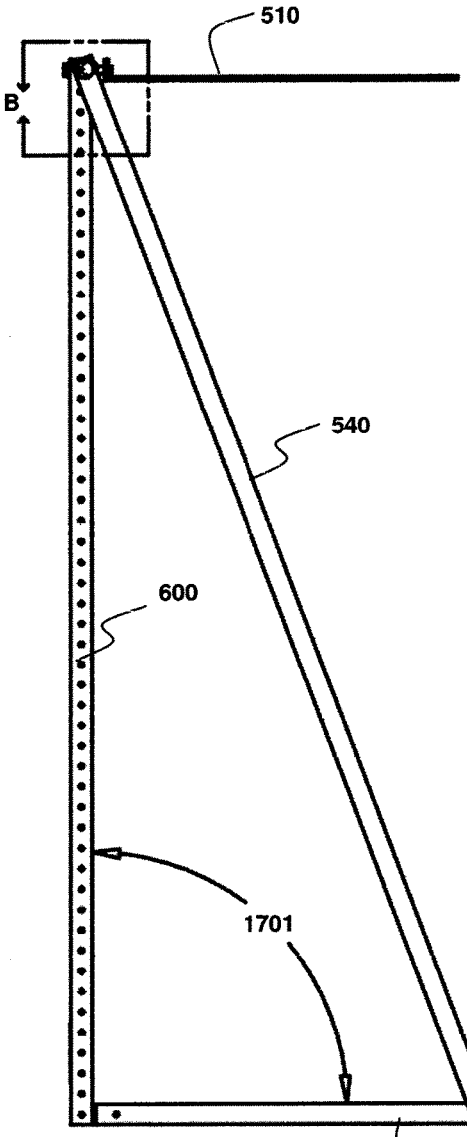
FIG. 17A shows how the rotational position in the plane of the wall (roll) can be adjusted.
Figure 17B:
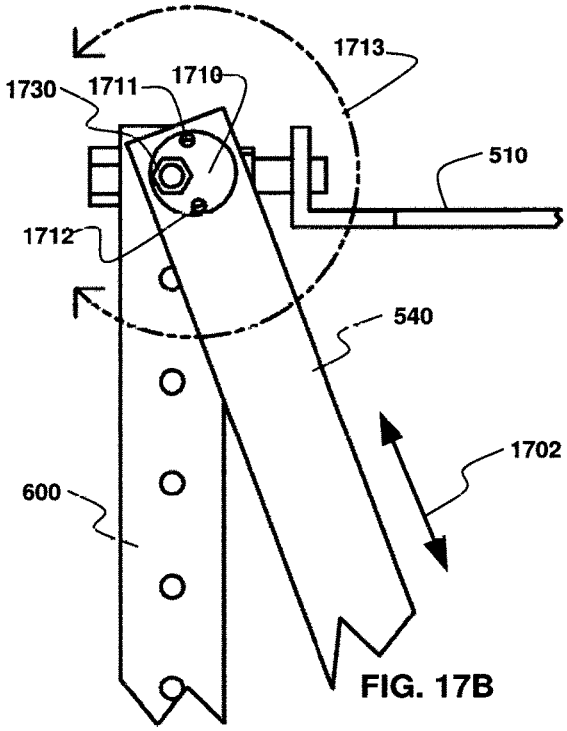
FIG. 17B shows a detailed view of the roll adjustment element located at the top of the frame assembly, representing the region marked as B in FIG. 17A.
Figure 17F:
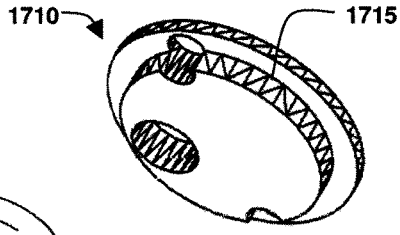
FIG. 17F shows an isometric view of the roll adjustment disk when looked at from the side opposite the view in FIG. 17E.
Figure 17E:
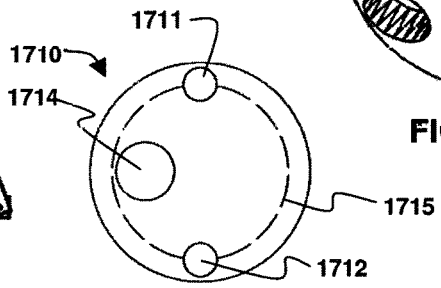
FIG. 17E shows a detail of the roll adjustment disk when viewed in the same orientation as FIG. 17B.

FIG. 17A shows a rear view of the bookcase frame 600, bookcase rear diagonal brace 540, bookcase rear bottom attachment member 520, and bookcase top attachment member 510. FIG. 17B shows a detailed view of the roll adjustment elements located at the top of the frame assembly, depicted as region B in FIG. 17A. Together, FIG. 17A and FIG. 17B illustrate how rotational position of the bookcase in the plane of the wall (bookcase roll) can be adjusted. Referring to FIG. 17A and FIG. 17B, bookcase roll is adjusted by rotating the roll adjustment disk, shown at 1710 in the direction of the arrows shown at 1713. The roll adjustment disk 1710 has an eccentric coupling with a first roll adjustment disk hole shown at 1711 and a second roll adjustment disk hole shown at 1712. The first and second roll adjustment disk holes, 1711 and 1712, engage with pins in the roll adjustment wrench, shown at 1720 in FIG. 17C and FIG. 17D, to provide a lever arm that allows the roll adjustment disk 1710 to be rotated. Rotation of the roll adjustment disk 1710 in the direction shown at 1713 causes the bookcase rear diagonal brace to move in the direction shown at 1702, which in turn causes the bookcase rear attachment member 520 to rotate (roll the bookcase) in the direction shown at 1701 in FIG. 17A. After the correct rotation about the z-axis (roll) of the bookcase (107 in FIG. 5A) has been established, the roll adjustment bolt, 1730 in FIG. 17B, can be tightened to maintain this rotational position. To further illustrate the way in which the roll adjustment disk is implemented and used, FIG. 17E shows a detail of the roll adjustment disk 1710 when viewed in the same orientation as FIG. 17B and FIG. 17F shows an isometric view of the roll adjustment disk 1710 when looked at from the side opposite the view in FIG. 17E. Referring to FIG. 17E, FIG. 17F, and FIG. 17B, there is a roll adjustment disk secondary diameter, shown at 1715, that engages inside of a hole of the same size of the bookcase rear diagonal brace 540. The bolt 1730 goes through the roll adjustment disk bolthole, shown at 1714. Note that roll adjustment disk bolthole 1714 is located off-center of the roll adjustment disk secondary diameter 1715. Thus, by using the roll adjustment wrench 1720 to rotate the roll adjustment disk 1710, the bookcase rear diagonal brace 540 can be moved in the direction shown at 1702.

Figure 18:
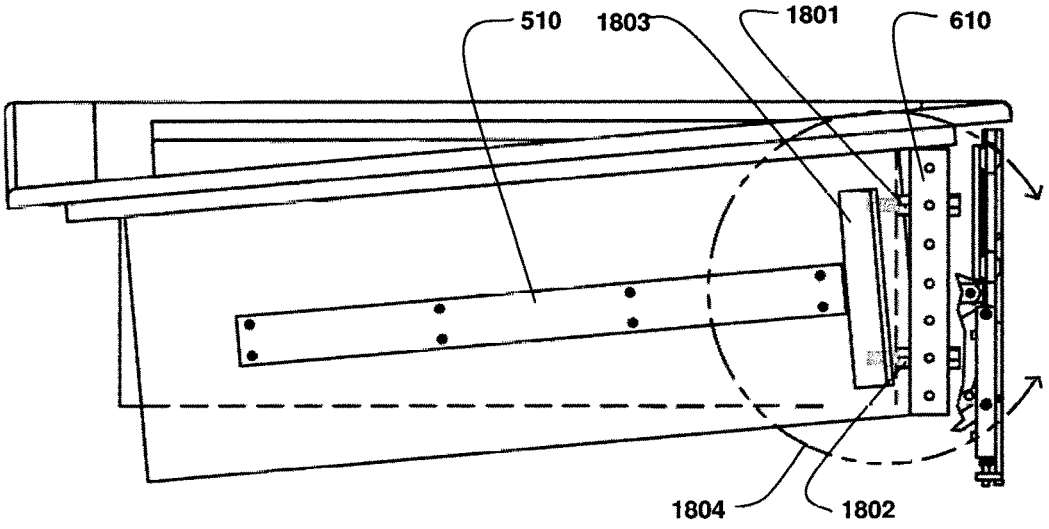
FIG. 18 shows a top view of the bookcase and frame and illustrates how vertical twist (yaw or skew) of the hidden hinge door bookcase can be adjusted.

FIG. 18 shows a top view of the bookcase and frame to illustrate one embodiment of how vertical twist (yaw or skew) of the hidden hinge door bookcase can be adjusted. Referring to FIG. 18, the bookcase top attachment member 510 (previously shown with reference to FIG. 5) is attached to a yaw bar, shown at 1803. The yaw bar 1803 is attached to the top frame element 610 (previously shown with reference to FIG. 6) through a first yaw bolt, shown at 1801, and a second yaw bolt, shown at 1802. By increasing the length of one yaw bolt, 1801 or 1802, relative to the length of the other yaw bolt, the yaw bar 1803 can be made to rotate in yaw movement path, shown at 1804. The yaw bar 1803 can also be called a skew bar.

To summarize the adjustments in at least one embodiment of the present invention in the six degrees of freedom previously described:

a. Adjustment of the bookcase in the y-axis (i.e. vertical movement of the bookcase) can be accomplished by upward and downward adjustment of the hinges by moving the vertical hinge adjustment bolts, 1111 in FIG. 11, and then tightening the king stud bolts, 1005 in FIG. 11;

b. Adjustment of the bookcase in the z-axis (i.e. in and out of the wall) can be accomplished by inward and outward adjustment of the hinges by moving the horizontal hinge adjustment bolts, 1113 in FIG. 11, and then tightening the hinge base mounting bolts, 1114 in FIG. 11;

c. Adjustment of the bookcase in an x-axis (i.e. movement of the bookcase in a right or left direction when viewed from the front of the bookcase in the wall) can be accomplished by sliding the bookcase left and right on the bookcase rear bottom attachment member, 520 in FIG. 5, and bookcase diagonal bottom attachment member, 530 in FIG. 5, and then securing the bookcase to the frame using screws;

d. Pitch of the bookcase (i.e. rotation about the x-axis or in/out movement of the top of the bookcase relative to the bottom of the bookcase) can be accomplished by moving the top hinge in a z-axis direction opposite of the direction that the bottom hinge is moved (before securing the bookcase to any part of the frame) as described with reference to adjustment of the bookcase in the z-axis;

e. Roll of the bookcase (i.e. rotation of the bookcase about the z-axis, which is rotation of the bookcase when viewed from the front) can be accomplished by rotation of the roll adjustment disk, 1711 in FIGS. 17A to 17E, which causes the bookcase rear diagonal brace, 520 in FIG. 17A, to move in the direction shown at 1702 in FIG. 17B; and f. Yaw of the bookcase (i.e. rotation of the bookcase about the y-axis or in/out movement of the left side of the bookcase relative to the right side) can be accomplished by movement of the yaw bolts, shown at 1801 and 1802 in FIG. 18, when the bookcase top has been secured to the bookcase top attachment member, shown at 510 in FIG. 18. Note that adjusting the yaw bolts, 1801 and 1802 in the same direction, will also cause a roll adjustment to occur since the top of the bookcase will move right or left relative to the bottom of the bookcase. Note also that at least one wood screw must attach the bookcase top attachment member (510 in FIG. 18) to the bookcase for adjustment.

Additional elements can be included with the embodiments. For example, the system could have decorative back and side panels that hide most of the hinge and frame from being visible from the rear. This might be beneficial if the door opening is between two rooms and it is desired that the system and method are visually attractive from both the front and the rear. The system or method could also include a lock or latch to secure the hidden door. The lock or latch could secure the door magnetically or mechanically using any system or method capable of being understood by anyone skilled in the art. The lock or latch could be activated to secure the hidden door directly by hand, or remotely using a wireless interface that communicates between the lock or latch and a remote control device. The wireless communication could use any protocol and technology capable of being understood by anyone skilled in the art such as WiFi (examples of which include IEEE 802.11b/g/n/ac), WiMax, a cellphone signal (2G, 3G, 4G, CDMA, EVDO, GSM/GPRS, LTE), Zigbee, WLAN, Bluetooth, optical wireless (infrared, laser, etc), near field communications, sonar, ultrasonic, etc. Alternatively, the wireless communication can comprise a wireless local area network (WLAN). The wireless communication may be direct, such as using an infrared link, Bluetooth, near field communication, or ZigBee. The wireless communication could use include an interface for "off-the-grid" networks (such are FireChat) where there is not cellular phone service or no internet connection.

A number of variations and modifications of the disclosed embodiments can also be used. The principles described here can also be used for in applications other than hidden hinge door bookcases. While the principles of the disclosure have been described above in connection with specific apparatuses and methods, it is to be clearly understood that this description is made only by way of example and not as limitation on the scope of the disclosure.

We claim:

1. A hidden hinge system for mounting a container into an aperture in a wall, the system comprising:

a frame, wherein the frame further comprises:

a vertical structure comprising a plurality of vertical segments configured to be positioned and attached to each other to adjust the height of the frame;

a base wherein the base extends outboard from the vertical structure to provide a horizontal surface configured for placement of the container; and a brace wherein the brace connects between:

a region of the base that is outboard from the vertical structure; and a region of the vertical structure above the point at which the base is attached to the vertical structure;

a top hinge module wherein:

the top hinge module is configured to attach to a top region of the aperture wherein the top region is proximate to the top of one side of the aperture;

the top hinge module comprises a top hinge mount that is attached to the vertical structure near the top of the vertical structure;

the top hinge module comprises a pair of interconnected four-bar linkages comprising a primary top hinge four bar linkage, a secondary top hinge four bar linkage, and six links wherein the interconnected four bar linkages rotate the top hinge mount relative to the top region;

the entire top hinge module is behind the front face of the wall when the hinge module is in its closed position;

the primary top hinge four-bar linkage is configured to rotate the frame forward from the wall;

the secondary top hinge four-bar linkage shares two links with the primary top hinge four-bar linkage; and the primary and secondary top hinge four bar linkages are configured to allow the top hinge mount to rotate about a vertical axis in an arc that spans at least 90 degrees from a closed position to an open position;

a bottom hinge module wherein:

the bottom hinge module is configured to attach to a bottom region of the aperture wherein the bottom region is below the top region;

the bottom hinge module is configured to attach to a bottom hinge mount located on the vertical structure at a point below the top hinge mount;

the bottom hinge module comprises a pair of interconnected four-bar linkages comprising a primary bottom hinge four bar linkage, a secondary bottom hinge four bar linkage, and six links wherein the interconnected four bar linkages rotate the top hinge mount relative to the bottom region;

the entire bottom hinge module is behind the front face of the wall when the hinge module is in its closed position;

the primary bottom hinge four-bar linkage is configured to rotate the frame forward from the wall;

the secondary bottom hinge four-bar linkage shares two links with the primary bottom hinge four-bar linkage; and the primary and secondary bottom hinge four bar linkages are configured to allow the bottom hinge mount to rotate about the vertical axis an arc that spans at least 90 degrees from a closed position to an open position; and at least three adjustment features selected from the group of:

a vertical adjustment feature that moves the vertical location of the holder relative to the opening;

an in-out adjustment feature that moves the holder horizontally into and out of the plane of the wall;

a side-to-side adjustment feature that moves the holder horizontally in the plane of the wall;

a pitch adjustment feature that moves the top of the holder in and out of the wall relative to the bottom of the holder;

a roll adjustment feature that moves the top of the holder laterally in a horizontal direction relative to the bottom of the holder; and a yaw adjustment feature that moves the left side of the holder into and out of the wall relative to the right side of the holder.

2. The system of claim 1 wherein:

the system further comprises the container;

the container is configured with horizontal shelves for holding books;

the aperture is a rectangular aperture;

the frame is a metal frame;

the metal frame comprises at least one square tubular aluminum member with holes at regular intervals;

the vertical segments in the vertical structure are positioned and attached using mechanical fasteners to adjust the height of the frame;

the mechanical fasteners comprise bolts;

the primary and secondary top hinge linkages are configured to allow the top hinge mount to rotate about an arc that spans at least 175 degrees from a closed position to an open position;

the primary and secondary bottom hinge linkages are configured to allow the bottom hinge mount to rotate about an arc that spans at least 175 degrees from a closed position to an open position; and the system comprises:

the vertical adjustment feature configured for adjusting the vertical location of the container relative to the aperture;

the in-out adjustment feature configured for adjusting the container horizontally into and out of the plane of the wall;

the side-to-side adjustment feature configured for adjusting the container horizontally in the plane of the wall;

the pitch adjustment feature configured for adjusting the top of the container in and out of the wall relative to the bottom of the container;

the roll adjustment feature configured for moving the top of the container laterally in a horizontal direction relative to the bottom of the container; and the yaw adjustment feature that moves the left side of the container into and out of the wall relative to the right side of the container.

3. The system of claim 2 wherein:

the vertical position of the shelves is user adjustable;

the container comprises a left face frame, a right face frame and a top face frame that are rigidly attached to the container wherein the front of the wall is in the same plane as the front of the left face frame, the right face frame, and the top face frame when the system is in the closed position;

the system further comprises a left case molding, a right case molding, and a top case molding wherein:

the left case molding, the right case molding, and the top case molding are in front of the left face frame, the right face frame, the top face frame, and the wall; and the left case molding, the right case molding, and the top case molding are rigidly attached to the left face frame, the right face frame, the top face frame, respectively;

the system further comprises a container top attachment member wherein the container top attachment member comprises a long slender horizontal element attached to the top of the vertical structure at one end and attached to the top of the container at the other end;

the vertical structure comprises a horizontal top frame element, a horizontal bottom frame element, a top frame stiffener, a first vertical top frame element, a second vertical top frame element, a first vertical mid frame element, a second vertical mid frame element, a first vertical bottom frame element, a second vertical bottom frame element, a top frame stiffener adapter, a bottom frame stiffener adapter, and a bottom frame stiffener wherein:

the horizontal top frame element, the horizontal bottom frame element, the first vertical top frame element, the second vertical top frame element, the first vertical mid frame element, the second vertical mid frame element, the first vertical bottom frame element, the second vertical bottom frame element, the top frame stiffener adapter, and the bottom frame stiffener adapter comprise square tubular aluminum with holes at regular intervals;

the horizontal top frame element is attached to the top frame stiffener adapter;

the top frame stiffener adapter is attached to the first vertical top frame element;

the first vertical top frame element is attached to the first vertical mid frame element;

the first vertical mid frame element is attached to the first vertical bottom frame element;

the first vertical bottom frame element is attached to the horizontal bottom frame element;

the horizontal bottom frame element is attached to the bottom frame stiffener adapter;

the bottom frame stiffener adapter is attached to the bottom frame stiffener;

the bottom frame stiffener is attached to the second vertical bottom frame element;

the second vertical bottom frame element is attached to the second vertical mid frame element;

the second vertical mid frame element is attached to the second vertical top frame element;

the second vertical top frame element is attached to the top frame stiffener;

the top frame stiffener is attached to the top frame stiffener adapter; and the top frame stiffener adapter is attached to the horizontal top frame element;

the vertical structure comprises at least one pre-machined square tubing connector wherein the connector comprises three orthogonal holes that intersect;

the top hinge module is configured to attach to a king stud in the top region of the aperture using:

a first nut plate and a second nut plate wherein the first nut plate and the second nut plate are located on the side of the king stud opposite of the rest of the top hinge module; and a plurality of king stud bolts that connect the first nut plate and the second nut plate to the rest of the top hinge module by going through holes in the king stud;

the bottom hinge module is configured to attach to the king stud in the bottom region of the aperture using:

a third nut plate and a fourth nut plate wherein the third nut plate and the fourth nut plate are located on the side of the king stud opposite of the rest of the bottom hinge module; and a plurality of king stud bolts that connect the third nut plate and the fourth nut plate to the rest of the top hinge module by going through holes in the king stud;

the system further comprises a door lock whereby the door can be remotely unlocked using a remote device that communicates with the door using a ZigBee protocol;

the vertical adjustment feature comprises vertical slots in the top hinge module and vertical slots in the bottom hinge module;

the in-out adjustment feature comprises a top hinge threaded horizontally-oriented adjustment member located in the top hinge module and a bottom hinge threaded horizontally-oriented adjustment member located in the bottom hinge module;

the side-to-side adjustment feature comprises a horizontal surface on which the container can be slid;

the pitch adjustment feature comprises a movement in one direction of the top hinge threaded horizontally-oriented adjustment member located in the top hinge module and an opposite movement of the bottom hinge threaded horizontally-oriented adjustment member located in the bottom hinge module;

the roll adjustment feature comprises an eccentric coupling located on the brace wherein:

the eccentric coupling comprising a first adjustment disk and a second adjustment disk that can be rotated relative to another; and rotation of the first adjustment disk relative to the second adjustment disk changes the length of the brace; and the container yaw adjustment feature comprises a pair of bolts located on the container top attachment member.

4. A system for mounting a holder into a wall opening that allows the holder to rotate about a vertical axis, the system comprising:

a frame, wherein the frame further comprises:

a vertical section that is adjustable in height;

a horizontal platform that extends outboard from the vertical section wherein the horizontal platform is configured for placement of the holder; and a brace connecting an outboard region of the platform to the vertical section at a location above the point at which the platform is attached to the vertical section;

a top hinge module wherein:

the top hinge module rotatably couples the vertical section to the opening near the top of the vertical section and the top of the opening;

the top hinge module is configured to rotate the frame about a vertical axis in an arc that spans at least 90 degrees between and open position and a closed position;

a bottom hinge module wherein:

the bottom hinge module rotatably couples the vertical section to the opening near the bottom of the vertical section and the bottom of the opening; and the bottom hinge module is configured to rotate the frame about a vertical axis in an arc that spans at least 90 degrees between and open position and a closed position;

the holder, wherein the holder further comprises a shelf; and at least three adjustment features selected from the group of:

a vertical adjustment feature that moves the vertical location of the holder relative to the opening;

an in-out adjustment feature that moves the holder horizontally into and out of the plane of the wall;

a side-to-side adjustment feature that moves the holder horizontally in the plane of the wall;

a pitch adjustment feature that moves the top of the holder in and out of the wall relative to the bottom of the holder;

a roll adjustment feature that moves the top of the holder laterally in a horizontal direction relative to the bottom of the holder; and a yaw adjustment feature that moves the left side of the holder into and out of the wall relative to the right side of the holder.

5. The system of claim 4 wherein:

the top hinge module comprises a pair of interconnected four-bar linkages comprising a primary top hinge four bar linkage, a secondary top hinge four bar linkage, and six links wherein the interconnected four bar linkages rotate the vertical section relative to the opening; and the bottom hinge module comprises a pair of interconnected four-bar linkages comprising a primary top hinge four bar linkage, a secondary top hinge four bar linkage, and six links wherein the interconnected four bar linkages rotate the vertical section relative to the opening.

6. The system of claim 4 wherein:

the top hinge module is configured to rotate the frame about a vertical axis in an arc that spans at least 175 degrees between and open position and a closed position; and the bottom hinge module is configured to rotate the frame about a vertical axis in an arc that spans at least 175 degrees between and open position and a closed position.

7. The system of claim 4 wherein:

the top hinge module and the bottom hinge module are configured to rotate the frame rearward behind the wall.

8. The system of claim 7 wherein:

the holder is configured with horizontal shelves for holding books;

the aperture is a rectangular aperture;

the holder comprises a left face frame, a right face frame and a top face frame that are rigidly attached to the holder wherein the front of the wall is in the same plane as the front of the left face frame, the right face frame, and the top face frame when the system is in the closed position;

the system further comprises a left case molding, a right case molding, and a top case molding wherein the left case molding, the right case molding, and the top case molding are in front of the left face frame, the right face frame, the top face frame, and the wall;

the system further comprises a holder top attachment member wherein the holder top attachment member comprises a long sender horizontal element attached to the top of the vertical section at one end and attached to the top of the holder at the other end.

9. The system of claim 4 wherein:

the vertical section comprises a plurality of square tubular aluminum members with holes at regular intervals;

the vertical section comprises a plurality of pre-machined square tubing connectors wherein the connectors comprise three orthogonal holes that intersect;

the square tubular aluminum members are positioned and attached using mechanical fasteners to adjust the height of the vertical section; and the mechanical fasteners comprise bolts that thread into the connectors.

10. The system of claim 4 wherein:

the top hinge module is configured to attach to a king stud in the top region of the aperture using:

a first nut plate and a second nut plate wherein the first nut plate and the second nut plate are located on the side of the king stud opposite of the rest of the top hinge module; and a plurality of king stud bolts that connect the first nut plate and the second nut plate to the rest of the top hinge module by going through holes in the king stud;

the bottom hinge module is configured to attach to the king stud in the bottom region of the aperture using:

a third nut plate and a fourth nut plate wherein the third nut plate and the fourth nut plate are located on the side of the king stud opposite of the rest of the bottom hinge module; and a plurality of king stud bolts that connect the third nut plate and the fourth nut plate to the rest of the bottom hinge module by going through holes in the king stud.

11. The system of claim 4 wherein:

the system comprises the vertical adjustment feature that moves the vertical location of the holder relative to the opening; and the vertical adjustment feature comprises vertical slots in the top hinge module and vertical slots in the bottom hinge module.

12. The system of claim 4 wherein:

the system comprises the in-out adjustment feature that moves the holder horizontally into and out of the plane of the wall; and the in-out adjustment feature comprises a top hinge threaded horizontally-oriented adjustment member located in the top hinge module and a bottom hinge threaded horizontally-oriented adjustment member located in the bottom hinge module.

13. The system of claim 4 wherein:

the system comprises the side-to-side adjustment feature that moves the holder horizontally in the plane of the wall; and the side-to-side adjustment feature comprises a horizontal surface on which the container can be slid.

14. The system of claim 4 wherein:

the system comprises the pitch adjustment feature that moves the top of the holder in and out of the wall relative to the bottom of the holder; and the pitch adjustment feature comprises a movement in one direction of the top hinge threaded horizontally-oriented adjustment member located in the top hinge module and an opposite movement of the bottom hinge threaded horizontally-oriented adjustment member located in the bottom hinge module.

15. The system of claim 4 wherein:

the system comprises the roll adjustment feature that moves the top of the holder laterally in a horizontal direction relative to the bottom of the holder; and the roll adjustment feature comprises an eccentric coupling located on the brace wherein:

the eccentric coupling comprising a first adjustment disk and a second adjustment disk that can be rotated relative to another; and rotation of the first adjustment disk relative to the second adjustment disk changes the length of the brace.

16. The system of claim 4 wherein:

the system comprises the holder yaw adjustment feature that moves the left side of the holder into and out of the wall relative to the right side of the holder; and the holder yaw adjustment feature comprises a pair of bolts located on the holder top attachment member.

17. A method for mounting an article of furniture into a wall aperture, the method comprising the steps of:

adjusting the vertical height of a frame to fit the vertical height of the wall opening, attaching a top hinge module near the top of the frame, wherein the top hinge module comprises a four-bar linkage;

attaching a bottom hinge module near the bottom of the frame, wherein the bottom hinge module comprises a four-bar linkage;

mounting the top hinge module onto a region near the top of the wall opening;

mounting the bottom hinge module onto a region directly below the top wall opening and near the bottom of the wall opening wherein the top hinge module and the bottom hinge module pivot in a common arc;

placing the article of furniture onto a horizontal base that is proximate to the bottom of the frame and extends outboard from the region near the bottom hinge;

connecting a brace diagonally from an outboard section of the horizontal base to a point on the frame above the bottom hinge;

adjusting the article of furniture in at least three ways selected from the group of:

adjusting the vertical location by moving the top hinge module and the bottom hinge module vertically relative to the wall aperture;

adjusting the frame in and out of the plane of the aperture by rotating a top hinge in-out adjustment member located in the top hinge module and a bottom hinge in-out adjustment member located in the bottom hinge module in the same direction;

adjusting the article of furniture from side to side by sliding the article of furniture on the horizontal base;

adjusting the pitch by rotating the top hinge in-out adjustment member and the bottom hinge in-out adjustment member in opposite directions;

adjusting the roll by rotating an eccentric first adjustment disk relative to an eccentric second adjustment disk where the first and second eccentric adjustment disks change the length of the brace; and adjusting the skew of the article of furniture by rotating a pair of bolts located on a furniture top attachment member that connects the top of the article of furniture to the top of the frame; and rotating the article of furniture in an arc from a closed position to an open position wherein the open position is rotated at least 90 degrees from the closed position.

18. The method of claim 17 wherein the method:

further comprises adjusting the article of furniture in at least five ways selected from the group of:

adjusting the vertical location by moving the top hinge module and the bottom hinge module vertically relative to the wall aperture;

adjusting the frame in and out of the plane of the aperture by rotating a top hinge in-out adjustment member located in the top hinge module and a bottom hinge in-out adjustment member located in the bottom hinge module in the same direction;

adjusting the article of furniture from side to side by sliding the article of furniture on the horizontal base;

adjusting the pitch by rotating the top hinge in-out adjustment member and the bottom hinge in-out adjustment member in opposite directions;

adjusting the roll by rotating an eccentric first adjustment disk relative to an eccentric second adjustment disk where the first and second eccentric adjustment disks change the length of the brace; and adjusting the skew of the article of furniture by rotating a pair of bolts located on a furniture top attachment member that connects the top of the article of furniture to the top of the frame; and rotating the article of furniture in an arc from a closed position to an open position wherein the open position is rotated at least 175 degrees from the closed position.

19. The method of claim 17 wherein:

adjusting the vertical height of a frame comprises mechanical bolts threaded into connectors that have three orthogonal intersecting through holes.

20. The method of claim 17 wherein:

attaching a top hinge module comprises a top hinge module having a pair of interconnected four-bar linkages comprising a primary top hinge four bar linkage, a secondary top hinge four bar linkage, six links, and seven pivot points; and attaching a bottom hinge module comprises a bottom hinge module having a pair of interconnected four-bar linkages comprising a primary top hinge four bar linkage, a secondary top hinge four bar linkage, six links, and seven pivot points.

* * * * *